US011430284B2

(12) United States Patent
Shepherd et al.

(10) Patent No.: US 11,430,284 B2
(45) Date of Patent: Aug. 30, 2022

(54) PROJECT EGM DISPLAY ONTO MOBILE DEVICE

(71) Applicant: IGT, Las Vegas, NV (US)

(72) Inventors: Jeffery S. Shepherd, Reno, NV (US); Dwayne R. Nelson, Las Vegas, NV (US); Warner R. Cockerille, IV, Reno, NV (US)

(73) Assignee: IGT, Las Vegas, NV (US)

( * ) Notice: Subject to any disclaimer, the term of this patent is extended or adjusted under 35 U.S.C. 154(b) by 0 days.

(21) Appl. No.: 16/992,261

(22) Filed: Aug. 13, 2020

(65) Prior Publication Data

US 2021/0027571 A1 Jan. 28, 2021

Related U.S. Application Data

(63) Continuation of application No. 14/924,391, filed on Oct. 27, 2015, now abandoned, which is a continuation of application No. 13/495,947, filed on Jun. 13, 2012, now abandoned.

(51) Int. Cl.
*G07F 17/32* (2006.01)

(52) U.S. Cl.
CPC ..... *G07F 17/3204* (2013.01); *G07F 17/3218* (2013.01); *G07F 17/3223* (2013.01); *G07F 17/3225* (2013.01); *G07F 17/3244* (2013.01); *G07F 17/3246* (2013.01); *G07F 17/3248* (2013.01); *G07F 17/3255* (2013.01)

(58) Field of Classification Search
None
See application file for complete search history.

(56) References Cited

U.S. PATENT DOCUMENTS

| | | | |
|---|---|---|---|
| 6,264,556 | B1 | 7/2001 | Izawa et al. |
| 6,676,522 | B2 | 1/2004 | Rowe et al. |
| 6,846,238 | B2 | 1/2005 | Wells |
| 7,611,409 | B2 | 11/2009 | Muir et al. |
| 7,850,528 | B2 | 12/2010 | Wells |
| 8,226,474 | B2 | 7/2012 | Nguyen et al. |
| 8,360,865 | B2 | 1/2013 | Walker et al. |
| 8,469,800 | B2 | 6/2013 | LeMay et al. |
| 8,545,308 | B2 | 10/2013 | Walker et al. |
| 8,545,321 | B2 | 10/2013 | Baerlocher et al. |
| 8,597,111 | B2 | 12/2013 | LeMay et al. |
| 8,606,179 | B2 | 12/2013 | Mizoguchi |
| 8,608,552 | B2 | 12/2013 | Walker et al. |
| 8,608,569 | B2 | 12/2013 | Carrico et al. |
| 8,613,659 | B2 | 12/2013 | Nelson et al. |

(Continued)

*Primary Examiner* — Jay Trent Liddle
(74) *Attorney, Agent, or Firm* — Neal, Gerber & Eisenberg LLP

(57) ABSTRACT

A gaming system including electronic gaming machines (EGMs) compatible with patron-controlled portable electronic devices, such as smart phones or tablet computers, is described. EGMs within the gaming system can be configured to establish communications with portable electronic devices. After communications are established, the EGMs can be configured to determine input and output capabilities of the portable electronic devices and instantiate temporary peripherals. A temporary peripheral instantiated on an EGM can be used to send output to the portable electronic device and/or receive input from the portable electronic device. In some embodiments, input from a temporary peripheral can be used to affect a state of a wager-based game played on the EGM.

14 Claims, 7 Drawing Sheets

(56) References Cited

U.S. PATENT DOCUMENTS

| | | | |
|---|---|---|---|
| 8,613,668 | B2 | 12/2013 | Nelson et al. |
| 8,622,836 | B2 | 1/2014 | Nelson et al. |
| 8,622,842 | B2 | 1/2014 | Nguyen et al. |
| 8,721,434 | B2 | 5/2014 | Nelson et al. |
| 8,827,813 | B2 | 9/2014 | LeMay et al. |
| 8,827,814 | B2 | 9/2014 | LeMay et al. |
| 8,845,418 | B2 | 9/2014 | Walker et al. |
| 8,876,595 | B2 | 11/2014 | Nelson et al. |
| 8,956,222 | B2 | 2/2015 | LeMay et al. |
| 8,974,285 | B2 | 3/2015 | Roper et al. |
| 8,979,628 | B2 | 3/2015 | Walker et al. |
| 8,992,302 | B2 | 3/2015 | Walker et al. |
| 8,992,329 | B2 | 3/2015 | Walker et al. |
| 9,011,236 | B2 | 4/2015 | Nelson et al. |
| 9,017,173 | B2 | 4/2015 | Baerlocher et al. |
| 9,039,523 | B2 | 5/2015 | Price et al. |
| 9,336,647 | B2 | 5/2016 | Nelson et al. |
| 9,367,835 | B2 | 6/2016 | Nelson et al. |
| 10,096,198 | B2 | 10/2018 | Griswold et al. |
| 10,121,318 | B2 | 11/2018 | LeMay et al. |
| 10,297,105 | B2 | 5/2019 | LeMay et al. |
| 2006/0058088 | A1 | 3/2006 | Crawford et al. |
| 2006/0068870 | A1 | 3/2006 | Crawford et al. |
| 2007/0060326 | A1 | 3/2007 | Juds et al. |
| 2007/0202941 | A1 | 8/2007 | Miltenberger et al. |
| 2008/0076572 | A1 | 3/2008 | Nguyen et al. |
| 2008/0096659 | A1 | 4/2008 | Kreloff et al. |
| 2008/0311971 | A1 | 12/2008 | Dean |
| 2009/0075724 | A1 | 3/2009 | Breeding et al. |
| 2009/0098943 | A1 | 4/2009 | Weber et al. |
| 2010/0124967 | A1 | 5/2010 | Lutnick et al. |
| 2010/0234099 | A1 | 9/2010 | Rasmussen et al. |
| 2010/0317423 | A1 | 12/2010 | Osborne |
| 2011/0034237 | A1 | 2/2011 | Schulhof |
| 2011/0115818 | A1 | 5/2011 | Chung et al. |
| 2012/0034962 | A1 | 2/2012 | Amaitis |
| 2012/0129611 | A1 | 5/2012 | Rasmussen et al. |
| 2013/0053148 | A1 | 2/2013 | Nelson et al. |
| 2013/0065668 | A1 | 3/2013 | LeMay et al. |
| 2013/0084963 | A1 | 4/2013 | Shorrock et al. |
| 2013/0084971 | A1 | 4/2013 | Frady |
| 2013/0084973 | A1 | 4/2013 | Frady |
| 2013/0130777 | A1 | 5/2013 | LeMay et al. |
| 2013/0137509 | A1 | 5/2013 | Weber et al. |
| 2013/0137510 | A1 | 5/2013 | Weber et al. |
| 2013/0252713 | A1 | 9/2013 | Nelson et al. |
| 2013/0316808 | A1 | 11/2013 | Nelson et al. |
| 2013/0337878 | A1 | 12/2013 | Shepherd et al. |
| 2014/0018153 | A1 | 1/2014 | Nelson et al. |
| 2014/0018155 | A1 | 1/2014 | Nelson et al. |
| 2014/0045584 | A1 | 2/2014 | Walker et al. |
| 2014/0155162 | A1 | 6/2014 | Mattice et al. |
| 2014/0278926 | A1 | 9/2014 | Close et al. |
| 2014/0295930 | A1 | 10/2014 | Walker et al. |

PROJECT EGM DISPLAY ONTO MOBILE DEVICE

PRIORITY CLAIM

This application is a continuation of, claims priority to and the benefit of U.S. patent application Ser. No. 14/924,391, filed on Oct. 27, 2015, which is a continuation of, claims priority to and the benefit of U.S. patent application Ser. No. 13/495,947, filed on Jun. 13, 2012, the entire contents of which is incorporated by reference herein.

BACKGROUND

1. Field of the Described Embodiments

The described embodiments relate generally to gaming systems, such as gaming systems deployed in a casino enterprise. More particularly, apparatus and method for enabling communications between an electronic gaming machine and portable electronic devices are described.

2. Description of the Related Art

Developing and maintaining a loyal customer base is a critical component of operating a successful casino enterprise. To develop a loyal customer base, casino enterprises attempt to generate interactions with their patrons that provide a unique and personalized game playing experience. As an example, casino enterprises offer patrons the opportunity to participate in a loyalty program. Via the loyalty program, patrons are offered various promotions and free items that encourage the patron to return to the casino.

In the loyalty program, the promotions can be tailored to the patron's preferences. As an example, if preferred, a patron can choose to receive promotional credits for game play on an electronic gaming machine and information regarding this preference can be stored to an account associated with the loyalty program. In general, information regarding the patron's preferences in regards to promotions as well as other activities within the casino enterprise, such as food, drink and room preferences, can be stored to their account associated with the loyalty program. The patron information stored in the account can be used to personalize the service and the game playing experience provided by the casino enterprise.

An ever increasing portion of patrons that visit casinos are regularly carrying portable electronic devices, such as smart phones, laptops, netbooks and tablet computers, on their person. The portable electronic devices provide 1) a means of communication allowing the patron to communicate with other individuals within or outside of a casino via a number of different communication modes, 2) a source of news and information, 3) a portal to the patron's on-line activities, such as social media applications, 4) support for entertainment features, such as audio/video playback and gaming applications, 5) a repository for personal information, such as financial information that enables financial transactions in a mobile wallet applications and 6) a means of capturing information, such as video images and audio recordings. Thus, portable electronic devices, such as smart phones, are becoming essential tools and in some instances, the primary electronic interface for many individuals.

The popularity of portable electronic devices allows for the possibility of utilizing their capabilities to further personalize and enhance the gaming experience in a casino gaming environment. In view of the above, methods and apparatus are desired that allow for complementary interactions with a portable electronic devices within a casino environment, such as when a patron is participating in game play on an electronic gaming machine.

SUMMARY OF THE DESCRIBED EMBODIMENTS

A gaming system compatible with patron-controlled portable electronic devices, such as smart phones, netbooks, laptops, tablet computers, smart cards and memory sticks, is described. The gaming system can include a server coupled to a number of different electronic wager-based gaming machines. The EGMs can be located within a single gaming establishment, such as a casino, or the EGMs can be distributed across multiple gaming establishments within a gaming enterprise.

EGMs within the gaming system can be configured to establish communications with portable electronic devices. After secure communications are established, the EGMs can be configured to determine input and output capabilities of the portable electronic device and instantiate temporary peripherals. A temporary peripheral on an EGM can be used to send output to the portable electronic device and/or receive input from the portable electronic device. In some embodiments, input from a temporary peripheral can be used to affect a state of a wager-based game played on the EGM.

In one embodiment, the EGM can utilize output capabilities of the temporary peripheral to output content, such as video content, audio content and/or sensory content such as vibrations. As an example, the EGM can be configured to generate and send a multimedia stream that is a representative of the video content and audio content output from devices coupled to an EGM cabinet, such as video content associated with a play of wager-based game output on the main display of the EGM and audio content associated with the player of wager-based game output to speakers on the EGM. Besides outputting content on the portable electronic device that is representative of what is output on the EGM, the EGM can be configured to generate customized content for output on the portable electronic device that is only output to the portable electronic device. For example, the EGM can be configured to control output of a bonus game presentation including video content and audio content on the portable electronic device that is only output on the portable electronic device and not the EGM.

In another embodiment, an EGM can be shared by a number of players. The EGM can be configured to output shared content that is intended for all of the players at the EGM and device-specific content that is intended only for a particular player. For example, in a card game, the EGM can output to a first display community cards that can be viewed by all of the players. Each of the players can have access to a portable electronic device including a display where each device is instantiated as a temporary peripheral on the EGM. Via the temporary peripherals, the EGM can be configured to control output on each of the portable electronics such that specific cards intended for viewing by only a particular player are output to each of the portable electronic devices.

One aspect of the described embodiments is related to an electronic gaming machine (EGM) for playing a wager-based game. The EGM can be generally characterized as comprising 1) a cabinet; 2) a communication interface, disposed within the cabinet, for establishing simultaneous communications with a plurality of user-controlled portable electronic devices; 3) a display, coupled to the cabinet, for outputting content associated with a play of the wager-based game; 4) a game controller, disposed within the cabinet and coupled to the display and the communication interface. The game controller can be configured 1) to control the play of the wager-based game; 2) register a first portable electronic device associated with a first player; 3) register a second portable electronic device associated with a second player; 4) initiate the wager-based game wherein the wager-based game is played by the first player and the second player; 5) determine shared content associated with the wager-based game wherein the shared content allows the first player and second player to play the wager-based game; 6) determine first player-specific content for the first player related to the play of the wager-based game, 7) determine player-specific content for the second player for the first player related to the play of the wager-based game; 8) send the first player-specific content to the first portable electronic device, 9) send the second player-specific content to the second portable electronic device and 10) output the shared content to the display.

Another aspect of the described embodiments is related to an electronic gaming machine (EGM) for playing a wager-based game. The EGM can be generally characterized as comprising: 1) a cabinet; 2) a communication interface, disposed within the cabinet, for establishing simultaneous communications with a first portable electronic device controlled by a first person participating in the place of the wager-based game and a second portable electronic device controlled by a second person not participating in the wager-based game; 3) a video display, coupled to the cabinet, for outputting video content associated with a play of the wager-based game; 4) a game controller, disposed within the cabinet and coupled to the video display and the communication interface. The game controller can be configured a) to control the play of the wager-based game; b) establish communications with the first portable electronic device; c) establish communications with the second portable electronic device associated; d) generate a first video presentation for output to the video display; e) generate a second video presentation for output to the first portable electronic device wherein presentation components or an arrangement of presentation components in the second video presentation is different from presentation components or an arrangement of presentation components in the first video presentation, f) generate a third video presentation for output to the second portable electronic device wherein presentation components or an arrangement of presentation components in the third video presentation is different from the presentation components or the arrangement of the presentation components in the first video presentation.

BRIEF DESCRIPTION OF THE DRAWINGS

The embodiments will be readily understood by the following detailed description in conjunction with the accompanying drawings, wherein like reference numerals designate like structural elements, and in which.

DESCRIBED EMBODIMENTS

Figure 1:
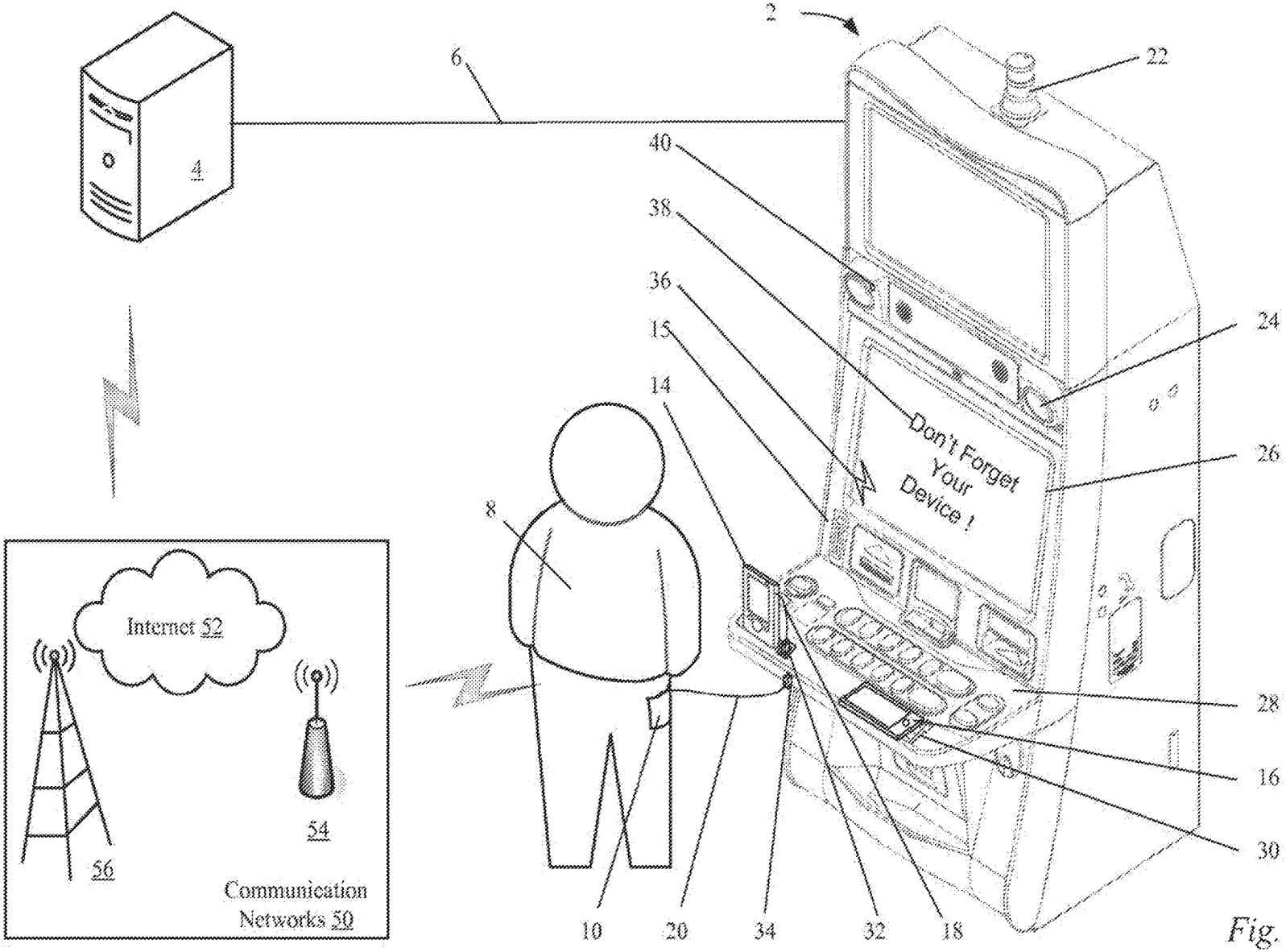
FIG. 1 shows a block diagram of a gaming system including EGMs, a server and mobile devices in accordance with the described embodiments.

In the following paper, numerous specific details are set forth to provide a thorough understanding of the concepts underlying the described embodiments. It will be apparent, however, to one skilled in the art that the described embodiments may be practiced without some or all of these specific details. In other instances, well known process steps have not been described in detail in order to avoid unnecessarily obscuring the underlying concepts.

A gaming system enabled to interface with portable electronic devices controlled by users of the gaming system is described. The gaming system can include various types of gaming devices, such as servers and electronic gaming machines (EGMs), coupled to one another via a network. Features that encourage and enable the use of portable electronic devices, such as cell phones, smart phones, laptops, netbooks and tablet computers, in a casino gaming environment can be provided. As an example, an EGM can be configured to establish secure communications with a portable electronic device. After secure communications are established, the EGM can be configured to determine input and output capabilities of the portable electronic device and instantiate a temporary peripheral. The temporary peripheral can be used to send output to the portable electronic device and/or receive input from the portable electronic device.

In one embodiment, the EGM can utilize output capabilities of the temporary peripheral to output content, such as video content, audio content and/or sensory content (e.g., vibrations). As an example, the EGM can be configured to generate and send a multimedia stream that is a representative of the video content and audio content output from devices coupled an EGM cabinet, such as video content associated with a play of wager-based game output on the main display of the EGM and audio content associated with the player of wager-based game output to speakers on the EGM. When the multimedia stream is generated, the EGM can be configured to consider communication properties, such as the bandwidth of the current connection between the EGM and the portable electronic device and, device properties, such as a display size and a resolution of the portable electronic device's display.

Besides outputting content on the portable electronic device that is representative of what is output on the EGM, the EGM can be configured to generate customized content for output on the portable electronic device that is only output to the portable electronic device. For example, the EGM can be configured to control output of a bonus game presentation including video content and audio content on the portable electronic device that is only output on the portable electronic device and not the EGM. As another example, the EGM can cause the portable electronic device to vibrate in response to certain events where vibration capabilities are only available on the portable electronic device and not the EGM.

The EGM can also be configured to utilize input capabilities of the portable electronic device. In one embodiment, input data received from a mobile device can be used to affect a state of a game played on an EGM. For example, from a portable electronic device, a player may be able to make wagers, initiate wager-based games and make choices during a play of a game that affect the outcome of the game.

In a particular embodiment, the EGM can be configured to output shared content that is intended for a number of players at the EGM and device-specific content that is intended only for a particular player. The device-specific content can be output to a portable electronic device carried by the particular player. As an example, an EGM with a table top video display can be configured to output shared content, such as community cards in a card game, where the shared content is viewed by a number of players arranged around the table. In addition, the EGM can send user-specific data, such as individual cards, to a mobile device carried by each player. The form factor of the mobile device may allow the player if desired to view their user-specific data without revealing it to nearby players.

In another embodiment, the EGM can be configured to output content to its output devices where copies of the output can be shared with other users. For example, the EGM can be configured to send a copy of what is output to a video display on the EGM to a portable electronic device. The copy can be viewed on a portable electronic device in communication with the EGM. For example, via their mobile device a friend on the player playing a wager-based game at the EGM can receive a copy of what is being output to the video display on the EGM. The copy can be formatted to better fit the capabilities of the portable electronic device. For example, the copy can be rendered in a lower-resolution and contents of the copy can be rearranged so that it is more suitable for viewing on a display screen associated with a portable electronic device.

Additional details of embodiments involving instantiating temporary peripherals that allow an EGM to receive input from a portable electronic device and output content to a portable electronic device are described with respect to the following figures. Device interactions within a gaming system including a general description of EGM-mobile device communications are discussed with respect to FIG. 1. With respect to FIGS. 2A and 2B, interactions between an EGM coupled to two temporary peripherals during play of a wager-based game are described. In these examples, gaming content is distributed to each of the EGM and the two temporary peripherals. In FIG. 3, a block diagram of an EGM coupled to a plurality of temporary peripherals is discussed. A flow chart of method in an EGM of distributing content and accepting input from temporary peripherals is described with respect to FIG. 4. Finally, with respect to FIGS. 5 and 6. Additional details of gaming devices including an EGM and the gaming system are described.

EGM-Mobile Device Interfaces

In this section, some examples of interfaces on an EGM that enable mobile device interactions are described. FIG. 1 shows an EGM 2 with interfaces for interacting with a portable electronic device. The EGM 2 can be part of a gaming system that includes a number of gaming devices and servers, such as 4. The communication connection 6 between the EGM 2 and the server 4 can be wired, wireless or a combination of wired and wireless communication links depending on the local and/or wide area network topology used within the gaming system. The EGM 2 can include a) displays, such as a main display 26 on which a wager-based game can be output, b) audio devices, such as speaker 24 for outputting sounds from the EGM and c) a player input panel 28 including buttons for making inputs associated with the play of the wager-based game. These devices can be controlled by a game controller (not shown) located within the cabinet of the EGM 2. Further details of the EGM's game controller and other gaming related methods that can be utilized within the gaming system are described with respect to FIGS. 4 and 5.

The EGM 2 can include a number of different types of interfaces that enable interactions with a portable electronic device, such as a smart phone or a tablet computer. One type of interface is a power interface. Another type of interface, described in more detail below is a communication interface. Via a power interface, power can be supplied to the portable electronic device. For instance, power interfaces 32 and 34 can be configured to receive a connector that allows an electronic device to be electrically coupled to the EGM 2. In one embodiment, the power interface 32 and 34 can be configured to accept a USB connector and thus, can be compatible with USB connector power requirements. Other types of power interfaces, such as a standard 120V receptacle can be provided.

In general, one or more power interfaces can be provided. When two or more power interfaces are provided the interfaces can employ the same or different power configurations. For instance, when two interfaces are provided, both can be configured to accept a USB connector or a first can be configured to be compatible with a USB connector while a second can be compatible with a two pronged connector. Thus, the voltage and current supplied by each power interface can vary from interface to interface depending on the power standard for which the power interface is configured. The one or more power interfaces can be located on different surfaces of the EGM 2. For instance, power interface 32 is located on an upper surface of the player input panel 28 and power interface 34 is located on a front surface of the player input panel 28. In other examples, the power interfaces can be located on a different surface, such as a front surface of the EGM cabinet.

A connector 18 is shown leading from power interface 32 to portable device 14 positioned on the player input panel 28 and a connector 20 is shown leading from power interface 20 to a portable device (not shown) located in the pocket 10 of user 8. At the device end, the connector, such as 18 or 20, can include a power interface compatible with the portable device, such as device 14 or the device located in the pocket of user 8. At the EGM end, the connector, such as 18 or 20, can include a power interface compatible with the EGM power interface. The interfaces at each end of the connector can be coupled via a cord. Typically, the interface between a connector (e.g., 18 or 20) and a portable device varies widely from model to model and from manufacturer to manufacturer where the interface at the device end can transmit communications and/or power to the portable device. Thus, in one embodiment, the connector, such as 18 and 20, can be provided by the user, such as 8.

In yet another embodiment, an interface 30 for wireless power transmission can be provided on the EGM 2. As an example, player input panel 28 includes a wireless power interface 30, such as a Powermat™ (Powermat Inc, Commerce Charter Township, Mich.). The wireless power interface can be compatible with a number of different types of devices. A portable device 16 is shown resting on the wireless power interface in a position that allows it to receive power via the wireless power interface 30. Power to the wireless power interface can be switched on and off depending on the machine status.

In particular embodiments, the interfaces 30, 32 and 34 can include sealing mechanisms that are configured to protect the interface in the case of spill, such as a user spilling a drink on the interface. Further, the interfaces can be configured to protect against electrostatic discharge (ESD). The ESD protection can include isolation circuits, filtering circuits, and suppression components, such as multilayer varistors, silicon diodes, and polymer-based suppressors. Suppression components protect the circuit by clamping the ESD voltage to a level that the circuit can survive. Connected in parallel with the signal lines, the suppressors clamp the ESD voltage and shunt the majority of the ESD current away from the data line, and the protected chip, to the appropriate reference. Typical references are the power rail and chassis ground.

In alternate embodiments, one or more of the interfaces 30, 32 and 34, can be configured as power and data interfaces or as a data only interface. For instance, via interface 32 and connector 18, power and data can be transmitted from the EGM 2 to the portable device 14 or only data can be transmitted between the EGM 2 and the device 14. In one embodiment, for security purposes, when a data interface is provided, the communications can be uni-directional such that only data can be sent from the EGM 2 to the portable device via the data interface. In other embodiments, the return communications that can be sent from the device to the EGM 2 and recognized by the game controller can be very limited for security purposes. The format of the return communications can be described a communication protocol (and/or implemented with an application program interface).

The EGM 2 can support one or more wireless communication interfaces for communicating with a portable device, such as 14 or 16. For instance, a first communication wireless interface can support Bluetooth™ communications, a second wireless communication interface can support communications via Wi-Fi™ (compatible with IEEE 802.11 standards) and a third wireless communication interface can support a NFC communication protocol (see FIG. 5 for more detail). In one embodiment, a wireless communication interface can be integrated or located proximate to the wireless power interface. For example, a wireless communication interface supporting an NFC communication protocol can be integrated with the wireless power interface 30. Thus, when the device 16 is placed near the wireless communication interface 30, NFC formatted communication can occur between the device 16 and the EGM 2. In other embodiments, the wireless communication interfaces can be placed in other locations within the EGM 2. Thus, the placement near the wireless power interface is discussed for the purposes of illustration only.

In one embodiment, the NFC communication can be used to exchange information to allow a secure pairing to be established between a user-controlled device and the EGM 2. For instance, Bluetooth™ pairing occurs when two Bluetooth devices agree to communicate with each other and establish a connection. In order to pair two Bluetooth wireless devices, a password (passkey) is exchanged between the two devices. The Passkey is a code shared by both Bluetooth devices, which proves that both users have agreed to pair with each other. After the passkey code is exchanged, an encrypted communication can be set up between the pair devices. In Wi-Fi paring, every pairing can be set up with WPA2 encryption or another type of encryption scheme to keep the transfer private. Wi-Fi Direct is an example of a protocol that can be used to establish point-to-point communications between two Wi-Fi devices. The protocol allows for a Wi-Fi device pair directly with another without having to first join a local network. The method makes it possible to share media from a phone, play multiplayer games or otherwise communicate directly, even when no router exists. Via pairing between the EGM 2 and portable electronic device, a portable electronic device may be able to utilize some of the functionality of secondary devices residing on the EGM 2. For instance, it may be possible for a player to print something from their portable electronic device using the printer on the EGM 2 when it is paired to the EGM 2.

The EGM 2 can include one or more support structures configured to receive a portable electronic device. The support structures can be integrated into the EGM cabinet such that a device placed in the support structure isn't easily knocked out of the support structure and placement of the device doesn't block access to input buttons on the EGM 2 during game play. The support structure can be configured to support a device various positions, such as upright, on its side or on its back. Further, the support structures can be configured to allow a device received in the support structure to be positioned in a preferred orientation. For instance, device 14 is placed in a support structure with a receptacle built into the player input panel 28 that allows the device to be orientated in an upright position. As another example, device 16 is placed flat on a ledge of the player input panel 28. The ledge can include an indentation or a high-friction material (anti-slip) that is designed to keep the device 16 from sliding off of the ledge. Support structures can be placed in other locations on the EGM cabinet and these examples are provided for the purposes of illustration only.

The support structure can include a stand or bracket for supporting the device. In one embodiment, the support structure can include a switch that is activated by a weight of the portable electronic device. The switch may be used for device detection purposes. The support structure can be sealed to provide protection in the event of spills. Further, it can include other tamper-resistant features, such as features that prevent the internal elements of the EGM 2 from being exposed. In one embodiment, a NFC interface can be located proximate to the support structure, such that it can be utilized when a device is placed in the support structure.

In alternate embodiments, the support structure, data interfaces and power interfaces can be incorporated into a secondary device utilized on the EGM 2. For instance, one or more of a support structure, a power interface or a wireless interface can be incorporated into a player tracking unit with a smart interface board (SMIB), a card reader, a bill validator or a printer. Further, all or a portion of the control of the power interfaces and/or wireless interface in the manner described herein can be performed by a secondary processor on the secondary device in conjunction with or independently of the game controller on the EGM 2. In another embodiment, all or a portion of the control of the power interfaces and/or wireless can be implemented in a "service window" type architecture (see FIG. 5 for more details).

In particular embodiments, the EGM 2 can be configured to provide indicators of a status of a power and/or data interface. For instance, in one embodiment, when a power and/or data interface is active, an icon indicating a status of the interface can be displayed on the EGM 2. For example, a lightning bolt 36 is shown on display 26 to indicate that power is actively being supplied to one of the power interfaces. Similarly, another icon can be displayed to represent an active communication session via a communication interface, such as a communication interface involving a wired or wireless connection between the EGM 2 and a portable electronic device.

In other embodiments, an interface, such as 30, 32 and 34, can be surrounded by lighted bezel, partially surrounded by a lighted bezel or include an indicator light near the interface. The lighted bezel can be configured to change color, emit a particular lighting pattern or combinations, such as flashing or steady, to indicate that the power interface is delivering power. For instance, a bezel or indicator can be lighted with a green color when power is being delivered to the interface and a red color when power is cut-off to the interface. In another example, a status light can be turned on when power is being delivered via the interface and turned off when power is not being supplied. Similar, status indicators can be used for communication interfaces to indicate an active or non-active communication session. For instance, the lighted bezel and/or audio feedback can be used to indicate proper device pairing, secure communications and/or recognition and successful establishment of communications.

Other types of feedback mechanisms can be utilized to indicate a status of an interface. For instance, audio devices can be used to provide audio feedback and/or vibration generating devices, which can also produce an audible buzz, can be used to provide feedback. These feedback mechanisms can be used alone or in combination with other feedback mechanisms, such as a light generating mechanism, to indicate the status of various processes implemented on the EGM 2.

In particular embodiments, the EGM 2 can be configured to detect the presence of a portable electronic device and/or user and encourage the user to retrieve their portable electronic device at the end of a game play session. For instance, the EGM 2 can include a camera, such as 40, with a field of view including the player input panel 28. Using image recognition software, the game controller can be configured to recognize an object, such as but not limited to a portable electronic device, left on the input panel 28. Image data received from a camera may also be used to recognize the presence of a user at the EGM 2 and possibly for eye tracking purposes. In one embodiment, a camera can be placed with a field of view of base of the EGM 2, such as the floor area beneath input panel 28. Image data from this camera can be used to recognize objects left on the floor of the EGM 2 near its base, such as a portable electronic or wallet that has fell onto the floor or a purse/bag left at the EGM 2. As described above, the presence of a portable electronic device can also be determined via signal strength and/or triangulation.

When a portable electronic device is detected near the EGM 2, the game controller can be configured, after certain game events, to notify a player to retrieve and/or disconnect their device from the EGM 2. For instance, after a cashout command is received by the game controller, the gaming controller can be configured to display a message 38, such as "Don't forget your device." As another example, the EGM 2 can be configured to emit a sound effect, such as a beeping to get the user's attention in regards to retrieving a device. In yet another example, the EGM 2 configured to flash lights in a distinctive pattern to get the user's attention.

EGM-Mobile Device-User Interactions

Next with respect to FIG. 1, user interactions with EGM 2 that can lead to a communication connection between the EGM 2 and mobile devices, such as 14 and 16, are described. Further, connection schemes that can be utilized between the mobile device and the EGM 2 are described. A user 8 with a mobile device, such as 14 and 16, can approach EGM 2 to play a wager-based game. The EGM 2 includes an upper video display 25 and lower video display 26 disposed in a secure cabinet 5 with locking mechanisms. The lower video display 26 can be used to display video images associated with the play of a wager-based game, such as a game outcome presentation. The upper video display 25 can be used to display attract features and a bonus game outcome presentation that is triggered from the play of the wager-based game on the lower video display 26. One or both of the upper video display 25 and lower video display 26 can include touch screens. In one embodiment, a portion of the video display screens can be allocated for control a remote device, such as server 4. This embodiment can be referred to as a service window and is described in more detail below with respect to FIG. 5.

To start game play, credits are first deposited on the EGM 2 that can be used for wagers. For instance, currency or a ticket voucher redeemable for credits can be inserted in bill acceptor 35. The ticket voucher can be validated by a remote server in the gaming system, such as 4. As another example, information can be transferred from the mobile devices, 14 or 16, to the EGM 2. The EGM 2 can include wireless and/or wired interfaces that enable communications between the EGM 2 and the mobile devices to be established.

The mobile devices, such as 14 or 16, can be configured as an electronic wallet and the information transfer can be used to initiate an electronic funds transfer that results in credits being deposited on the EGM 2. The use of the mobile device in for these transactions can alert the EGM 2 to the presence of the mobile device. In response to the use mobile device for these purposes, the EGM 2 may attempt to initiate communications with the mobile device that allow it to use the mobile device's wide area network access capabilities.

Whether credits are deposited via a tangible medium, such as a ticket voucher or paper currency, or electronically, such as via the mobile device, the user is likely to be near the front of the EGM 2. Thus, if they are carrying a mobile device, it is likely to be in the general area of the EGM 2. For example, the mobile device is likely to be at least an arm's length distance from the EGM 2. Thus, the EGM 2 can establish a connection with the mobile device 14 or 16 that can be used to facilitate a connection with a remote device via wide area networking capabilities provided by the mobile device 14 or 16.

After depositing credits, a player can make a wager and initiate a game on the EGM 2. The input panel 28 can be used to make selections related to the play of the game, such as a wager amount, and initiate the game. After the game is initiated, a game outcome presentation can be generated on EGM 2. It can include video images output to the displays and accompanying sound effects. For example, during a video slot game played on EGM 2, the game controller can generate a game presentation including a series of video images that show at different times an amount wagered on the game, symbols moving and then stopping in a final position and an award amount associated with game based upon the amount wagered and the final position of the symbols.

In some instances, after depositing credits, typically before beginning game play, a player can initiate a player tracking session on the EGM 2. During a player tracking session, information associated with game play, such as amounts wagered and amounts won can be stored to a player tracking account. This information is often referred to as player tracking information. To encourage repeat business, gaming enterprises often provide complimentary awards ("comps"), such as free meals and lodging, to players. The value of the comp can depend on the value of the player to the casino based upon their player tracking information, such as amounts wagered over time.

The player tracking account can be associated with the user that has initiated game play on EGM 2 and can be hosted on a remote device, such as server. The player can initiate a player tracking session by providing player tracking account information that allows their player tracking account to be located on a device that hosts player tracking accounts. In one embodiment, the player tracking account information can be stored on the mobile devices, 14 or 16, and transmitted to the EGM via a compatible communication interface. In another embodiment, the player tracking account information can be stored on a card that can be read by card reader 15. In yet another embodiment, a service window application can be used to enter player tracking account information.

In other embodiments, the EGM 2 can be configured to detect nearby mobile devices for the purposes of initiated an attract feature that encourages the player to engage in game play at the EGM 2. Thus, the EGM 2 can be aware of nearby mobile devices associated with users not using the EGM 2. These mobile devices may be associated with patrons walking near the EGM 2, standing near the EGM 2 or playing a game on a nearby gaming machine. The ability to detect or be made aware of nearby mobile devices can be provided independently of whether attract features are provided.

In general, when a nearby mobile device is detected or the EGM 2 is made aware of a nearby mobile device (e.g., another device may detect the presence of the mobile device and transmit the information to the EGM), the EGM 2 may attempt to establish communications with the device. In one embodiment, the EGM 2 can be configured to contact and attempt to access the wide area network capabilities of a mobile device. For instance, the EGM 2 can be configured to contact a mobile device associated with a player utilizing the EGM 2 use the wide area network capabilities of the mobile device to communicate with a remote device, such as a remote server.

During game play, the EGM 2 can be configured to send information to the mobile devices, such as 14 or 16, that is for a player's personal use. For instance, the EGM 2 can be configured to send a copy of a screen displayed on 25 or 26 showing the outcome of the game or a bonus game. The player can save this screen copy as a keepsake and may optionally upload it to a social media site. Further, the EGM 2 can be configured to receive information from the mobile device that affects the game play. For instance, the EGM 2 can be configured to receive player tracking information, voucher information and/or player preference information that allows the gaming experience to be customized for a particular player. Thus, the EGM 2 can be configured to interact with a mobile device to send data intended for storage on the mobile device as well as to send data to the mobile device that is intended for a remote device.

The EGM 2 can be configured to detect mobile devices carried by employees of the gaming operator that move throughout the casino floor. In one embodiment, the EGM 2 can be configured to contact these devices for the purposes of utilizing their network access capabilities. These devices can transmit information that allows them to be identified by the EGM 2. In one embodiment, the EGM 2 can be configured to only utilize specially designated devices, such as devices carried by operator employees for the purposes of accessing and engaging in communications with devices on a wide area network, such as the Internet. In yet another embodiment, which is described in more detail below, user devices can be required to have a particular application installed, such as an application provided by the gaming operator, before the mobile devices can be utilized for accessing a wide area network.

In yet another embodiment, a wireless or wired interface can be located within the EGM cabinet that can be used to communicate with a mobile device. The EGM 2 can be configured such that the wireless or wired interface is only activated when the interior of the EGM 2 has been accessed in an authorized manner. The EGM 2 may be configured to only permit communications via this interface when the EGM 2 is an operator mode, such as when the cabinet has been opened via an approved procedure. At other times, the EGM 2 may not be configured to communicate with remote device via a wide area network.

Communications Topologies in a Gaming System Including Mobile Devices

In this section, different communication topologies involving mobile devices in a gaming system are described. In one embodiment, mobile devices, such as 14 or 16, can communicate directly with the EGM. For example, as described above, the communications can be through a wired or wireless interface available on the EGM. Via an EGM to mobile device communication interface, the mobile device may be able to communicate with the game controller on the EGM, a secondary controller on the EGM, a remote device, such as server 4 or combinations thereof. Examples of a secondary controller include but are not limited to a player tracking controller, a card reader controller, a bill validator controller or a printer controller. In the case of the remote device, such as server 4, the EGM 2 can act as an intermediary in the communications.

In one embodiment, for security purposes, the EGM 2 can be configured to not allow direct communications between the game controller and the mobile device. For example, the mobile device may communicate with a secondary controller in a secondary device coupled to the EGM, such as a card reader controller in a card reader. The secondary controller may include a communication interface that allows it to communicate with a remote device, such as server 4. In a particular embodiment, the communications between the secondary controller and the game controller can be well defined to limit the type of information that is transferred the secondary controller and the game controller. Depending on how the communications are defined, the EGM 2 may be able to receive limited types of information or not any information from the mobile device via the secondary controller.

In another embodiment, the communications between the mobile device and the EGM 2 can be uni-directional. For example, the EGM can be configured to directly send information to the mobile devices, such as 10 or 16, but not directly receive information from the mobile device. In one embodiment, information can be sent from a mobile device to an EGM 2 via an intermediary device, such as server 4 or a secondary device, such as card reader 15. The intermediary device can be configured to screen and limit the information from the mobile device that can be received by the EGM 2.

In yet other embodiments, the EGM 2 and the mobile devices may only communicate indirectly using the communication capabilities associated with a mobile device. For example, mobile devices may be able to establish communication connection with server 4 which then acts as intermediary for communications between the mobile devices, such as 14 and 16, and EGM 2. The EGM 2 can be configured to output information via a display device or some other mechanism that enables the indirect mobile device to EGM communications via an intermediary device, such as server 4, via a local area network, such as 6, or via a wide area network, such as 52. For example, the EGM can be configured to output a QR code that a mobile device can scan. Information embedded in the QR code can allow the mobile device to establish communications with the EGM 2 via server 4, local area network 6 or wide area network 52.

The mobile devices can communicate with a device, such as server 4, using one of its inherent communication capabilities. The mode of communication that is used can vary depending on the communication networks 50 that are available to the mobile devices. For example, the server 4 and EGM 2 can be located on a local area network, such as a local area network 6 within a casino. The local area network can be a private network only accessible from the casino and its vicinity. Via wireless access point 54, the mobile device can access the local area network, such as 6 to access the server 4 or optionally EGM 2. Thus, via wireless access point 54, the mobile device may be able to communicate with 1) a server 4, 2) an EGM 2 where the server 4 acts as intermediary in the communications or 3) directly with the EGM 2 via the local area network 6.

In other embodiments, the server 4 and/or the EGM 2 can access a wide area network, such as the Internet 52 and have an Internet address. Via the wireless access point 54 or a cellular data connection 56, the mobile device, such as 14 or 16, can access the Internet 52 to establish communications with server 4 or EGM 2. Again, the server 4 can act as intermediary in the communications between the mobile device and the EGM 2. Thus, the mobile devices can establish communications with server 4 via the Internet 52 and then, the server 4 can establish communications with the EGM 2 using an alternative method.

In various embodiments, different EGMs in a gaming system can be provided with different communication capabilities. Thus, a combination of the communication topologies used above can be used for communications between mobile devices and EGMs in a gaming system. For instance, a mobile device can communicate with a first EGM via a direct wireless connection between the first EGM and the mobile device and then communicate with a second EGM via a wireless access point that connects to a local area network on which the second EGM is located.

Figure 2A:
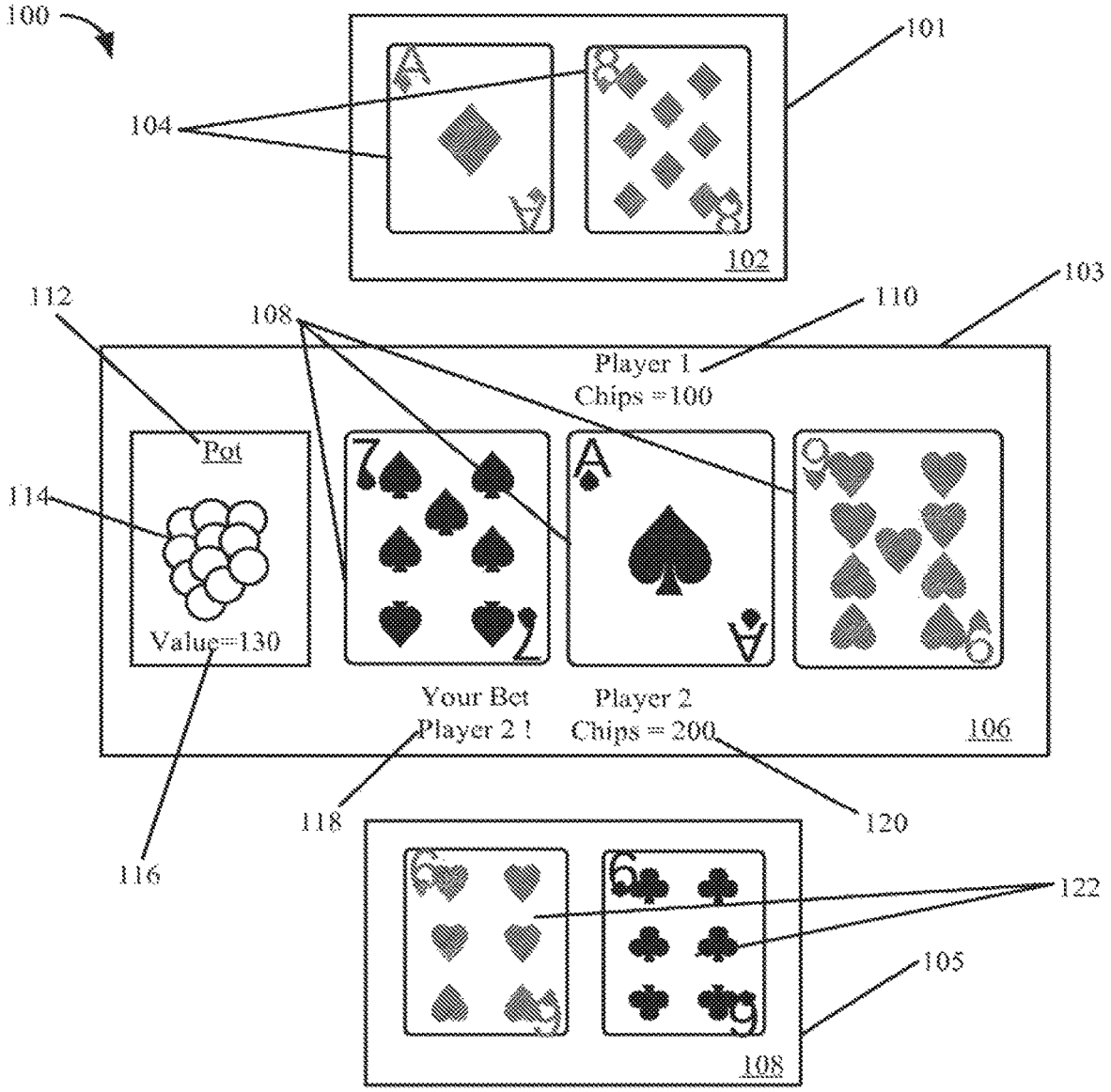
FIGS. 2A and 2B shows a block diagram of an EGM coupled to two temporary peripherals during play of a wager-based game where content is distributed to each of the EGM and the two temporary peripherals in accordance with the described embodiments.
Figure 2B:
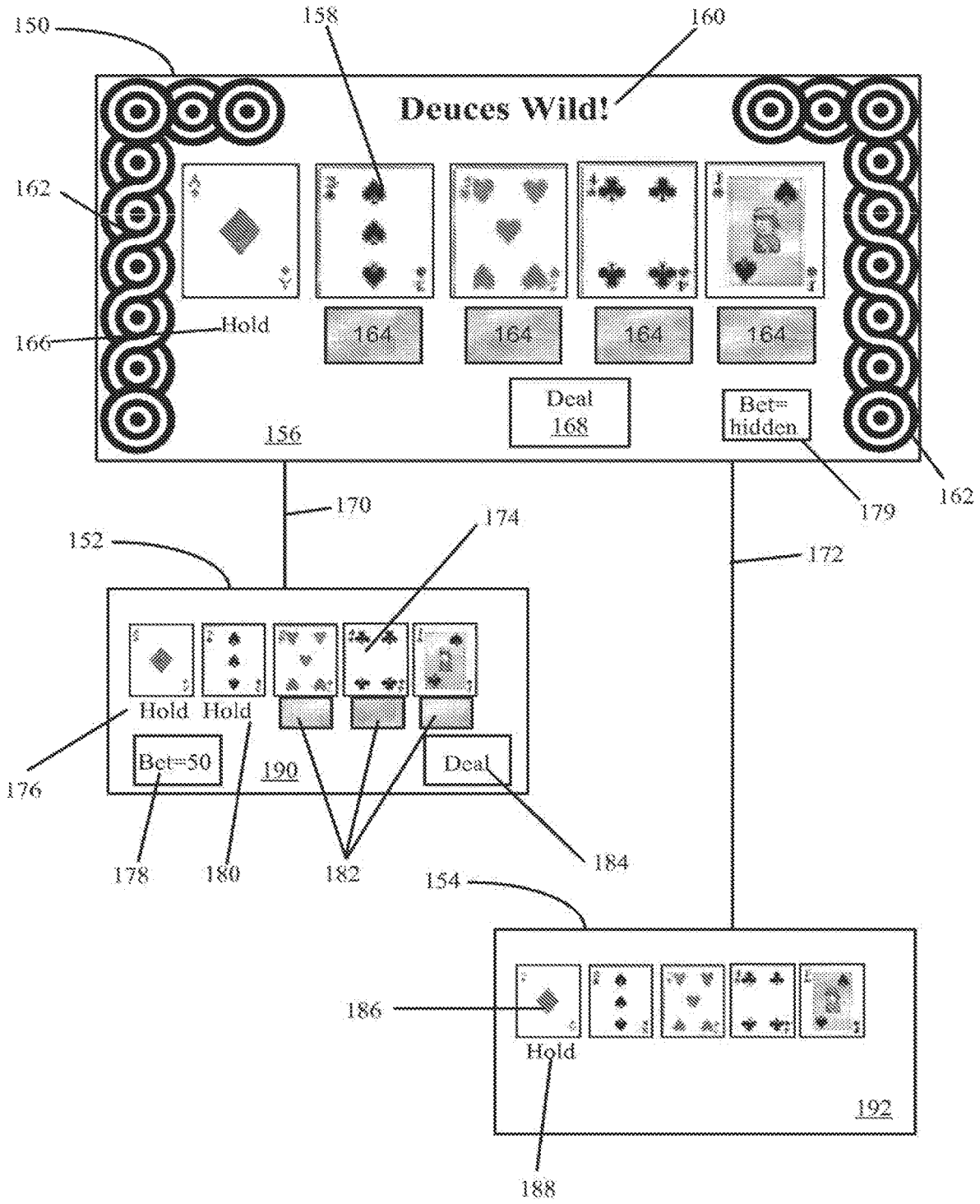
Figure 3:
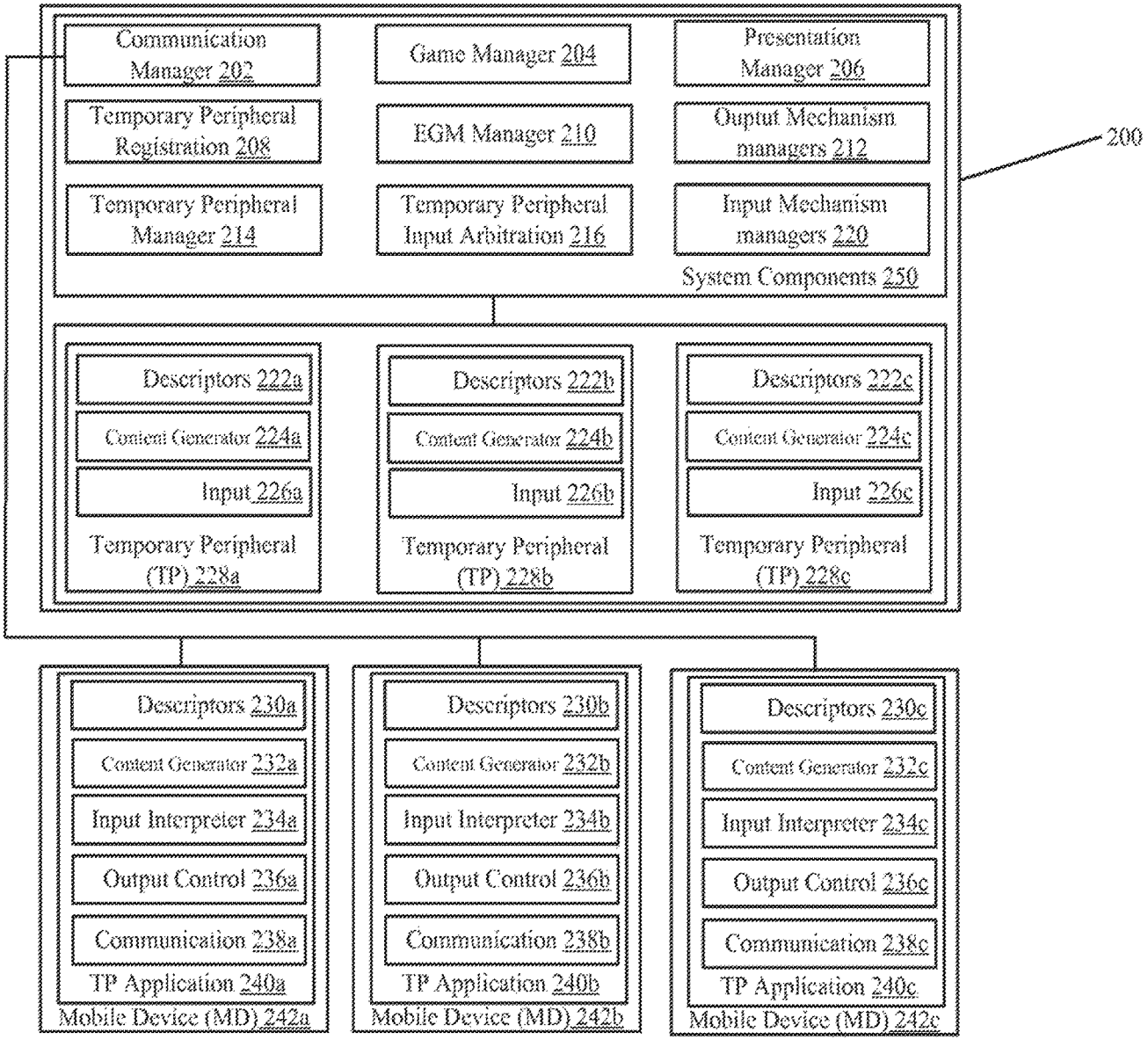
FIG. 3 is a block diagram of an EGM coupled to a plurality of temporary peripherals in accordance with the described embodiments.

Content Distribution and Input Response in an EGM Configured for Temporary Peripherals FIGS. 2A and 2B shows a block diagram of a gaming system 100 including an EGM 103 coupled to two portable electronic devices, 101 and 105, during play of a wager-based game. The EGM can include a number of peripheral devices mechanically coupled to the EGM, such as one or more displays (e.g., mechanical and/or video displays), cash-in devices, cash-out devices, input buttons and communication interfaces that allow communications to be established between the EGM and the portable electronic devices. Via the communication interfaces, portable electronic devices can be communicatively coupled to the EGM.

In one embodiment, the EGM 103 can be configured to establish secure communications and instantiate the portable electronic devices, 101 and 105, as temporary peripherals so that a game controller and/or other logic devices on the EGM can utilize input/output capabilities of the devices. As an example, a portable electronic device can be a smart phone or a table computer, carried by a player that is utilizing the EGM. Additional details of a game controller configured to instantiate temporary peripherals to allow communications with portable electronic devices are described with respect to FIG. 3.

A component on the EGM 103, such as a game controller or other logic device on the EGM, can be configured to generate content that is output to peripheral devices located on each of the EGM and/or the portable electronic devices. For example, the EGM 103 can be configured to output video content to a display 106 mechanically coupled to the EGM 103, a display 102 on the portable electronic device 101 communicatively coupled to and instantiated as a temporary peripheral on the EGM 103 and a display 108 on the portable electronic device 105 communicatively coupled to and instantiated as a temporary peripheral by the EGM 103. The video content can be related to a game involving wagering played on the EGM 103.

Video content is one example of content that can be output to the EGM 103 and portable electronic devices 101 and 105. Other types of content can include but are not limited to audio content and haptic content, such as force feedback. The type of content that is output can vary depending on the capabilities of the EGM and the portable electronic devices communicatively coupled to the EGM. Further, the content that is output can vary from device to device based upon the capabilities of a particular device.

In particular embodiments, the content that is output from the EGM can be shared content that is intended to be received by all of the players or can be individual content that is intended for a particular individual. In addition, content can intended for a group of individuals that is less than all of the players, such as groups of players competing as teams against other players. Different types of content can be output to different devices. For example, shared content can be output to display 106 that is intended for all the players participating in a card game while individual content can be sent to display 102 on portable device 101 and to display 108 on portable electronic device 105. The individual content can be intended for viewing by one player but not the other players. For example, video content sent to device 101 can be intended for the player holding device 101 while video content sent to device 105 can be intended for the player holding device 105. When the individual content is sent to each player as part of a game, the game may be constructed such that is beneficial for each player not share the individual content.

An EGM with a display that outputs shared content can be arranged so that multiple players can see the shared content when near the EGM. For example, display 106 can be configured horizontally as part of a table top device. In a table top configuration, players can be arranged around the table so that they can each view the shared content and view one another. In another example, the display can be configured vertically. The vertical configuration may allow a number of players facing the display 106 to view the shared content. Other display configurations are possible and these examples are provided for the purpose of illustration only.

As described above, the individual content can be sent to each portable electronic device. For example, first individual content can be sent to portable electronic device 101 and second individual content can be sent to portable electronic device 105. In the case of video content, the form factor of the portable electronic device can allow the player to orientate in such a matter that the content is not viewable by other players. In the case of audio content, the audio content can be output to the device that is not easily heard by other players. For example, audio content can be output to earbuds or headphones coupled to the portable electronic device.

In another embodiment, shared and individual content can be sent to the same device. For example, shared and individual content can be output to display 108 on portable electronic 105. The shared content can be the content output on display 106 which can also be output to display 108. Thus, the shared content can be duplicated on multiple displays. The individual content can be the video content shown on display 108 in FIG. 2A. In one embodiment, the portable electronic device 105 can be arranged to allow a user to switch between the shared and individual content. For example, the shared individual content can be shown in tabbed windows that are user selectable. By selecting one of the tabs, the shared or the individual content can be viewed. In another embodiment, the shared and individual content can be displayed simultaneously, such as in a side by side manner.

When shared content and individual content is displayed to the same device, the EGM may enable remote users to participate in a game. For example, a first player carrying device 101 can be located near EGM 103 such that they can view display 106 to receive the shared content. A second player carrying device 105 can be located away from EGM 103 such that the display 106 is not visible to the visible. This player can view the shared shown on display 106 on display 108. In addition, the player can view individual content on display 108.

To illustrate a game involving shared and individual content, a card game is shown in FIG. 2A. The card game can involve making poker hands from shared community cards where each participant is dealt individual cards that are used to make poker hands with the community cards. Texas hold'em is an example of a card game involving community cards and player specific cards. In FIG. 2A, player 1 has been dealt hand 104 which includes the ace and eight of diamonds whereas player 2 has been dealt hand 122 which includes the six of hearts and the six of clubs. Each player's hand can be considered as individual content which is only shown on their respective devices 101 and 105.

The shared content is output to display 106. Display 106 can be visible to both players. For example, display 106 can be part of a table top EGM where each player sits on opposite sides of the display facing one another. In this example, the shared content includes the community cards 108, the chips or credits, 110 and 120, available to player 1 and player 2 respectively for wagering, a pot 112, a value of the pot 116 and a graphical representation of a value of the pot 114. The community cards 108 include the seven of spades, the ace of spades and the nine of hearts.

As part of the game, the players 1 and 2 can take turns making wagers. In the example of FIG. 2A, a message 118 indicating it is player 2's turn is shown as part of the shared content on display 106. As described above, the EGM can be configured to accept input from the portable electronic devices. For example, player 2 can use device 105 to indicate a wager amount when it is their turn and player 1 can use device 101 to indicate a wager amount when it is their turn. The EGM 103 can also be configured to accept inputs for indicating a wager amount. In this instance, a player may be able to make inputs via their portable electronic device or via an input device on EGM 103.

In one embodiment, an EGM 103 can be configured to accept inputs from different portable electronic devices and input devices on the EGM 103 simultaneously. For example, EGM 103 can be configured to accept inputs from a touch screen on device 101, a touch screen on EGM 103 and a touch screen on 105 on device 105 simultaneously. In another embodiment, the EGM 103 can be configured to accept inputs from particular input devices at a certain times. For instance, when it is player 2's turn to make a wager, the EGM 103 can be configured to accept input only from device 105 and ignore input from device 101. When it is player 1's turn, the EGM 103 can be configured to ignore input from device 105 and accept input from device 101.

The EGM can be configured to accept or ignore input from different combinations of input devices depending on a game state for a particular game that is being implemented on the EGM. For example, one game may involve players making input simultaneously at certain times. Thus, during these game states, the EGM can be configured to accept input devices from multiple input devices simultaneously, such as input devices on portable devices 101 and 103.

In another example, a game may involve particular players only providing input at certain times. Thus, during these game states, the EGM can be configured to accept input from one input device or one combination of input devices while ignoring inputs from other input devices or other combinations of input devices. For example, at certain times the EGM 103 can be configured to accept input from portable electronic device 101 and ignore input from device 105 and at other times accept input from device 105 and ignore input from device 101.

An EGM, such as 103, can be configured to generate many different types of game states over time. Thus, the combinations of input devices in which an EGM is configured to accept or ignore can vary over time. Thus, at a first time and a first game state, the EGM 103 can be configured to accept input from devices 101 and 105 simultaneously. At a second time when a second game state is generated, the EGM 103 can be configured to accept input from only one of devices 101 and 105 at a time. As another example, at a first time, the EGM 103 can be configured only to accept input from an input device mechanically coupled to the EGM and ignore inputs from the portable electronic devices 101 and 105 and at a second time the EGM 103 can be configured to accept inputs from peripheral devices mechanically coupled to the EGM and peripheral devices mechanically coupled to each of the portable electronic devices 101 and 105.

In particular embodiments, the EGM 103 can be configured to control the portable electronic devices, 101 and 105, to indicate that it is expecting input from the portable electronic device. For example, when it expects input from device 105, the EGM 103 can be configured to send a signal to device 105 that causes it to vibrate, emit a sound, display a message, flash, etc., to indicate to the player that it is expecting input from the device. In addition, the EGM 103 can display messages to one of its permanent peripheral devices, such as message 118 on display 106, to notify a player it is their turn to provide an input.

In some embodiments, only a subset of the input functions available on the EGM 103 may be available on the portable electronic devices, 101 and 105. For example, the EGM 103 can be configured to require that a game be initiated based upon inputs provided to permanent peripherals coupled to the EGM 103. After the game is initiated, the EGM 103 can be configured to accept inputs from the portable electronic devices that allow a player to play the game.

As another example, the EGM 103 can be configured to only accept inputs related to a play of a primary game from permanent peripherals coupled to the EGM. However, the EGM 103 can be configured to trigger bonus games during the play of the primary where the bonus game is played using inputs received from the portable electronic device. In one embodiment, the bonus game can be individual content that is output to a particular portable electronic device. Thus, a first player may receive a bonus game as individual content on their portable electronic devices and the other players may not even be aware that the first player is playing a bonus game. Further, if the other players are aware, they may not be able to determine the content of the bonus game provided to the first player because the first player may hold their portable electronic device such that the content is not visible to the other players.

In the example described with respect to FIG. 2A, the shared content provided information that was shared by a group of players to participate in a game. In other embodiments, shared content can be content that a player wishes to share for social purposes. For example, an EGM can be configured to output content to permanent peripherals on the EGM and output content to temporary peripherals, such as portable electronic devices. The content that is output to the temporary peripherals can be representative of what is being output to the permanent peripherals on the EGM. This sharing capability may allow a player participating in the game played at the EGM to have their friends also see portions of the content being output to the EGM to allow their friends to share in the experience. An example of this type of sharing is described with respect to FIG. 2B.

In FIG. 2B, an EGM 150 including display 156 is coupled to two portable electronic devices 152 and 154. In one embodiment, display 156 can be a touch screen display. The portable electronic devices, 152 and 154, include displays 190 and 192, respectively. The EGM 150 is configured to generate a wager-based game. A card game 160 called "Deuces Wild" is being output to display 156. The card game 160 is shown in a state after a game has been initiated and five cards have been dealt to the player. In one embodiment, the card game can be a poker related game.

The game presentation output to display 156 includes embellishments 162, a game name 160, five cards, such as 158, a card status message 166 including the card has been held, an active button 168 to deal more cards and a four active input buttons 164. A selection of one of the input buttons allows the card above the input button to be held. When the deal button 168 is selected, the non-held cards can be replaced with new cards and the outcome of the card game can be determined.

A communication session has been established between the EGM 150 and the portable electronic device 152. The physical transfer of information can occur over connection 170 which can be a wired or wireless connection as described above with respect to FIG. 1. In one embodiment, the player controlling device 152 can be near the EGM 150 such that the player can view the game information on display 156 as well as on their portable device 152. In another embodiment, the player controlling device 152 can be remote from EGM 150 such that the display 156 is not visible to the player. For example, the player may have connected to the EGM 150 from a remote location inside or outside of a gaming establishment including EGM 150. In another example, the player may have established a communication between the device 152 and EGM 150 at EGM 150 and then moved away from the EGM.

A functional copy of what is displayed on the EGM 150 is also output to device 152. The functional copy allows the player to view information and provide inputs for playing the game on their portable electronic device 152. It is referred to as a functional copy because it is not a duplicate copy of what is output to the EGM 150. For example, the presentation on the portable electronic device 152 doesn't include the name of the game 160 or the embellishments 162 shown on display 156 of the EGM. In addition, the deal button 184 is at a different location on display 190 than on display 156 of the EGM.

Typically, the display, such as 190, on a portable electronic device, such as 152, will be smaller than the display, such as 156, on the EGM 150. To accommodate a smaller display, the EGM 150 can be configured to generate a mobile version of the game. The mobile version of the game as compared to a full version displayed on the EGM can include elements deemed non-essential, such as embellishments 162 or name 160, removed. In addition, components used to present game such as game objects (e.g., cards) and input buttons can be rearranged for the mobile game version as compared to the EGM version. For example, on the portable electronic device 152, the cards 174 and input buttons 182 are arranged similarly to what is displayed on the EGM 150. However, the deal button 184 is arranged differently as compared the deal button 168.

In one embodiment, the EGM 150 can be configured to hide certain information that is normally displayed on the EGM 150 and instead output it only to the player's portable electronic device. The option can be initiated automatically or at a request of a player. As an example, a player may not wish other's to see how much they are betting on a particular game and request the EGM 150 to hide this information on the EGM display 156 but output it to the player's portable electronic device 152. Thus, on the EGM display 156, the amount bet 179 is hidden and on the portable electronic device 152, the amount bet 179 is shown as fifty.

In one embodiment, the EGM 150 may be configured not to show what information is hidden. For example, the box 179 including "Bet=hidden" may be removed and not shown. Later, the EGM 150, automatically or in response to an input from the player may unhide the information. For instance, when the EGM 150 loses communication with a portable electronic device, such as 178 on which hidden information is displayed, the EGM 150 may unhide on the EGM display 156 the hidden information and again output it to the display. In another example, after a player cashes out, any hidden information may again be displayed on the EGM 150.

As described above, the EGM 150 can be configured to accept inputs from a portable electronic device such that a player can play a game via inputs made on their mobile device. In FIG. 2A, a player is selecting cards to hold via their mobile device 152. Holds 176 and 180 have been placed on the first two cards. In this example, the hold 180 has been made on the portable electronic device display 190 and the input data has been sent to the EGM 150. The EGM display 156 has not yet been updated in response to the input information and thus, the hold is not reflected on the EGM display 156.

In one embodiment, the portable electronic device 152 is configured to update its game presentation independently of the EGM 150. Thus, the update can be reflected on the portable electronic device before the EGM 150. In other embodiments, the portable electronic device 152 can send inputs it has received to the EGM 150. The EGM 150 can receive the inputs and determine what changes need to be made to the game presentation on both the EGM display 156 and the portable electronic device display 190. Then, the EGM 150 can send instructions to the portable electronic device that allows changes made to the game presentation to be reflected on the portable electronic device. Since the EGM 150 is controlling the update, the updated presentation can be displayed first on the EGM 150 then the portable electronic device 152, simultaneously on the EGM and the portable electronic device or it can be updated first on the portable electronic device and then the EGM.

In particular embodiments, multiple portable electronic devices can be coupled simultaneously to the EGM 150. For example, portable electronic device 152 and 154 are simultaneously coupled to EGM 150. The portable electronic device 154 can be located near the EGM 150 such that a direct communication is established between the device 154 and the EGM 150. Also, the portable electronic device 154 can be located remotely from the EGM 150 and can communicate with the EGM through one or more intermediary devices. Thus, connection 172 can be a direct or an intermediary connection.

In one embodiment, EGM 150 can be configured to share content with the portable electronic device 154. In this example, a non-functional copy of what is output to the EGM display 156 and portable electronic device display 190 is output on portable electronic display 192. The non-functional copy may allow a user of device 154 to follow along the game that is being played on the EGM 150 in conjunction with inputs from device 152 but not provide inputs that influence the outcome to the game. For example, as shown on display 192, the user of device 154 can view the same cards 186 and the hold designation that is shown on EGM display 156.

Like the other portable electronic device 152, not all of the presentation content shown on EGM display 156 is output to portable electronic device 154. On device 154, details such as input buttons 164 and 168, embellishments 168 and the name 160 are not shown on the device. In other embodiments, a screen shot of what is displayed on the EGM at a particular time can be captured and sent to a portable electronic device 192. Thus, all of the video content shown on the EGM display 156 can also be displayed on portable electronic device display 192.

A gaming establishment may enable multiple portable electronic devices to receive live feeds of gaming information from an EGM so that their friends can share in the experience. For example, in one embodiment, a player can provide a list of friends and contact information that allows live of feeds of gaming information to be sent to their friends devices. When a player starts playing a game on an EGM, a device in a gaming system, such as a server or the EGM, can send notifications to the listed friend that the individual is engaged in a game play session. The notification can include information that allows the friend to subscribe via one of their devices, such as portable electronic device, to a live feed including game play information, such a game presentation that is output to the EGM display 156.

In another embodiment, a player can input contact information for a particular individual. In response, the EGM 150 alone or in conjunction with another device, such as a system server, can send a notification to the individual that allows them to subscribe to a live feed of a game being played on the EGM 150. When the individual subscribes to the feed, the EGM and/or a system server can send information that allows a presentation generated on the EGM to also be output to a subscriber's device. As an example, an EGM can generate a video stream can be received by one or more remote devices, such as portable electronic devices.

In another example, the EGM can send updates of game states to remote server. In response, the server can generate a video presentation stream or send instructions to remote devices that allow the video presentation to be generated on the remote device. For example, a portable electronic device, such as 154, can execute an application that is configured to receive instructions from the server that allow a non-functional copy of the game output on device 150 and 152 to be generated. As another example, the server can stream a non-functional copy of the game output on device 150 and 152 to device 154.

FIG. 3 is a block diagram of an EGM 200 coupled to a plurality of temporary peripherals. The EGM 200 can include a number of system components 250 that can be used to control a wager-based game. In one embodiment, the system components can be software processes executing on the game controller.

In the example described with respect to FIG. 3, the EGM is configured to instantiate user-controlled portable electronic devices as a temporary peripheral. As a temporary peripheral, the EGM can control output of content to the portable electronic device by sending commands and/or data to output devices coupled to the EGM. The commands and data can be sent through an API (Application program interface) associated with the portable electronic device. In addition, the EGM can be configured to receive input via devices associated with the portable electronic devices, such as input associated with a touch screen, a camera or sensors located on the portable electronic. Again, the input can be generated via communications between the EGM and the portable electronic device through an API provided with the portable electronic device.

In other embodiments, the interactions between the EGM and the portable electronic device can be at a higher level. For example, the EGM can package content, such as video content for output on the EGM, and send it to the EGM. The portable electronic device using applications available on the portable electronic can process and output the packaged content. In this example, the EGM may not interact directly with devices on the portable electronic device, such as via an API. Thus, the communications between the EGM and the peripheral device can be considered higher level communications.

The EGM manager 210 can respond to events, route events to the various system components as needed and maintain overall control of the EGM 200 during game play. The game manager 204 can be configured to generate various game states during the play of a wager-based game on the EGM according to the rules of the wager-based game. It can receive events from the game manager, such as inputs from input devices related to game decisions and send events to the EGM manager, such events related to a particular game state. The presentation manager 206 can be configured to generate presentations for the game states determined by the game manager 204. The presentation for each state can be output via permanent peripheral devices on the EGM, such as mechanical, video displays or bonus devices.

The output mechanism managers 212 can control the various permanent peripheral output devices on the EGM, such as displays, printers, lights, etc. The input mechanism managers 220 can control and receive input data from the permanent peripheral input devices on the EGM such as touch screens, input buttons, a bill acceptor/validator, a card reader, etc. The input mechanisms managers and output mechanism managers can send information, such as event information, to the EGM manager 210 and receive instructions from the EGM manager 210.

The communication manager 202 can be used to communicate with remote devices, such as remote servers or remote portable electronic devices. In a particular, when portable electronic devices, such as 242*a*, 242*b* and 242*c*, are instantiated as temporary peripherals on the EGM 200, communications between the temporary peripherals and the EGM 200 can be routed through the communication manager 202. For example, inputs received from the mobile device 242*a* related to playing a wager-based game can be routed through the communication manager 202 to the EGM Manager 210.

The temporary registration manager 208 can be used to register a mobile device, such as 242*a*, 242*b* or 242*c*, as a temporary peripheral. The temporary registration process can be initiated after a communication session is established between the mobile device and the EGM 200. During the registration process, the EGM 200 can a) attempt to learn about the capabilities of the mobile device, b) determine whether the mobile device is authorized to communicate with the EGM 200, c) determine functions that are going to be performed by the mobile devices, such as receiving input from the mobile device or sending output to the mobile device and d) determine parameters used to implement the determined functions. For example, when video is to be output to the mobile device, the registration manager 208 can determine whether video content is to be streamed to mobile devices from the EGM or whether commands for generating the content are to be sent to the mobile device that allow the content to be generated locally.

In one embodiment, the resolution in which to generate the content can be determined. The resolution can be based upon the screen size on the mobile device, the available network bandwidth and the network speed. As described above, when a copy of a game presentation is output to the mobile device, the copy can be generated in a resolution that is compatible with the output capabilities of the mobile device which can be different than the output capabilities of the EGM 200. In general, the EGM can be configured to tailor content for output to a particular electronic device that considers the unique output capabilities of each portable electronic device.

After successful registration, a temporary peripheral, such as 228*a*, 228*b* and 228*c*, can be instantiated on the EGM 200. The temporary peripheral can be used by the EGM manager 210 to interface with the mobile device including sending content to the mobile device and receiving content from the mobile device. A unique set of descriptors, such as 222*a*, 222*b* and 222*c*, can be stored for each temporary peripheral. The descriptors can describe the parameters that define how the EGM is to interact with the mobile device, such as a resolution for generating content.

The content generators, such as 224*a*, 224*b* and 224*c*, can be configured to generate content for each temporary peripheral. For example, a content generator can send instructions and data that allow the content to be generated locally on the mobile device or can stream content to the mobile device. The input processor, such as 226*a*, 226*b* and 226, on each temporary peripheral instantiated on the EGM 200 can be used to process input received from the temporary peripherals and forward raw or processed input to the EGM manager 210. For example, input received from a touch screen on the mobile device can be processed and then sent to the EGM manager 210 or can be sent to the EGM manager 210 as raw input data and then subsequently processed on the EGM 210. As described above, in one example, a touch screen on a mobile device can be used to provide inputs for controlling a wager-based game played on the EGM 200. In another example, other devices, such as a camera or sensors (e.g., accelerometers), can be used to provide inputs used to control a wager-based game played on the EGM or provide input for other applications executions executing on the EGM.

The temporary peripheral manager 214 can keep track of the temporary peripherals, such as 228*a*, 228*b* and 228*c*, instantiated on the EGM. In one embodiment, the temporary peripheral manager 214 can monitor communications between the temporary peripheral and the EGM. If communications are degrading in quality, the manager 214 can be configured to take remedial actions, such as decrease a resolution at which content is being streamed to the temporary peripheral.

In another embodiment, the temporary peripheral manager 214 can be configured to determine when to terminate an instantiated temporary peripheral. For example, when communications are lost between the EGM and the temporary peripheral or if the mobile device can no longer be detected, the temporary peripheral manager 214 can terminate the temporary peripheral. As another example, if a mobile device has been registered at the EGM 200 and the EGM 200 is directly communicating with the mobile device as a temporary peripheral, the manager 214 can be configured to terminate the temporary peripheral when certain events occur, such as after a cashout request is received or the credits on the EGM go to zero. After termination of a temporary peripheral, a mobile device associated with the terminated temporary peripheral may have to re-register before it can interact again with the EGM 200.

The temporary peripheral input arbitration 216 can be configured whether to accept input from all or a portion of the temporary peripherals at a particular time. As described above, in certain game states, the EGM 200 can be configured to receive inputs from multiple temporary peripherals simultaneously, such as if each of the three temporary peripherals is controlled by different players during a play of a game. In other game states, the EGM 200 can be expecting input from only a particular device at particular times. For example, one temporary peripheral can be associated with a player's taking turns betting. In this example, the, input arbitration 216 can be configured to ignore input from certain devices.

In the instance where it is expecting input from a particular device, input arbitration 216 can be configured to send a reminder message to the temporary peripheral from which it is expecting input. For example, the input arbitration 216 can cause a message indicating it is the player's turn to bet on the device controlled by the player. In another example, the input arbitration in lieu of or in combination with the message can send instructions to the mobile device that cause it to buzz or behave in a particular manner to remind the player it is their turn.

In one embodiment, an application, such as 240*a*, 240*b* and 240*c*, can be instantiated on each mobile device, such as 242*a*, 242*b* and 242*c*, to allow it to act as a temporary peripheral. The application can include a communication component, such as 238*a*, 238*b* and 238*c*, which controls communications related to the application between the mobile device and the EGM 200. For example, the communication component might be used to establish a secure wireless communication session between the mobile device and the EGM. The descriptors, such as 230*a*, 230*b* and 230*c*, can store information related to parameters negotiated during the registration process. The content generators, such as 232*a*, 232*b* and 232*c*, can be used to generate content locally and/or unpack and display content received from the EGM or a server, such as streaming content.

The input interpreters, such as 234*a*, 234*b* and 234*c*, can be used to process input received from the mobile device as it pertains to a particular application. For example, an input interpreter can process input from a touch screen on the mobile and send it to a remote EGM. As another example, the input interpreter can receive input from one or more sensors on a mobile device can be processed and sent to the EGM 200. The output control, such as 236*a*, 236*b* and 236*c*, can be used to control output to one or more devices on the mobile to output content associated with the temporary peripheral, such as video output, audio output or force feedback output.

In the example described with respect to FIG. 3, three temporary peripherals are shown instantiated on the EGM. At various times, no temporary peripherals can be instantiated, one temporary peripheral can be instantiated, two temporary peripherals can be instantiated or more than three temporary peripherals can be instantiated. Thus, in FIG. 3, the number of temporary peripherals shown is for the purposes of illustration only and is not meant to be limiting.

Figure 4:
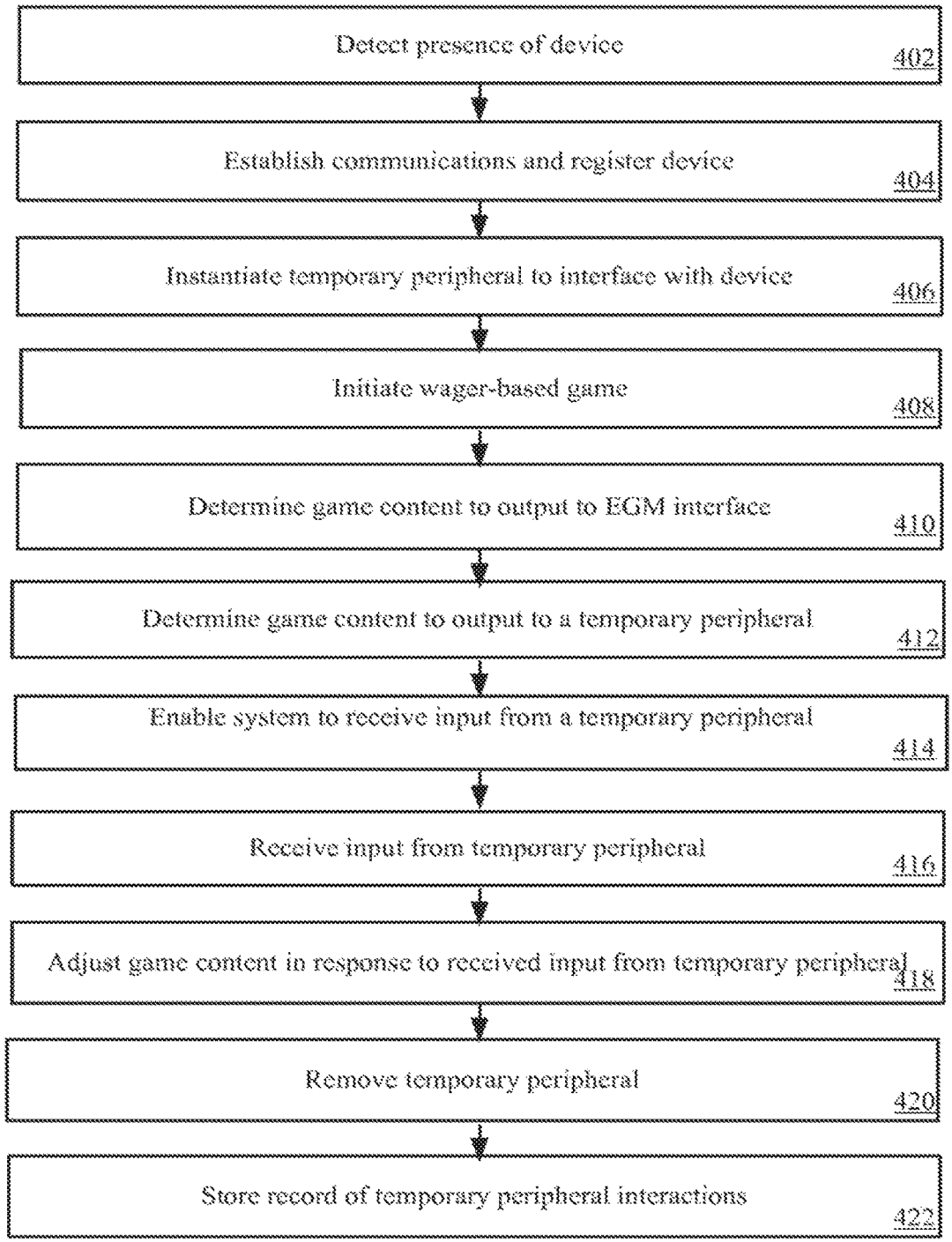
FIG. 4 is a flow chart of method in an EGM of distributing content and accepting input from temporary peripherals in accordance with the described embodiments.

FIG. 4 is a flow chart of method 400 in an EGM of distributing content and accepting input from temporary peripherals. In 402, the EGM can detect the presence of a mobile device locally at the EGM and/or receive a request to establish communications with a mobile device locally at the EGM or located remotely from the EGM. In 404, the EGM can establish communications with a mobile device and register the mobile device to become a temporary peripheral. In 406, the EGM can instantiate temporary peripheral to interface with the mobile device as described above with respect to FIG. 3.

In 408, the EGM can initiate a wager-based game. In 410, the EGM can determine game content to output on the EGM interface, i.e., the permanent peripherals coupled to the EGM. In 412, the EGM can determine game content to output to a temporary peripheral. For example, the EGM can generate game content to stream to the temporary peripheral or can send instructions and data to an application executing on the temporary peripheral that allows the content to be output.

In 414, the EGM can configure itself to allow it to receive input commands from the temporary peripheral. In one embodiment, the EGM can be configured to receive control commands from the temporary peripheral for making wagers and indicating other in-game decisions. In 416, the EGM can receive input from the temporary peripheral. The input can be raw data or could be pre-processed in some manner. For example, the application executing on the temporary peripheral can be configured to determine that a touch screen input corresponds to a particular event and then send a notification to the EGM of the event. The notification may or may not include the raw data that allowed the application to determine the event occurred.

In 418, the EGM can be configured to adjust game content in response to the received input from the temporary peripheral. In 420, the EGM can determine to remove the temporary peripheral from execution. For example, when the mobile device stops communicating with the EGM, the temporary peripheral can be stopped and removed from the EGM. In 422, the EGM can store a record of temporary peripheral interactions. For example, the EGM can store information related to identifiers for the mobile device, functions enabled, actions performed, a start time, an end time, inputs received, etc.

Gaming Devices and Systems

Figure 5:
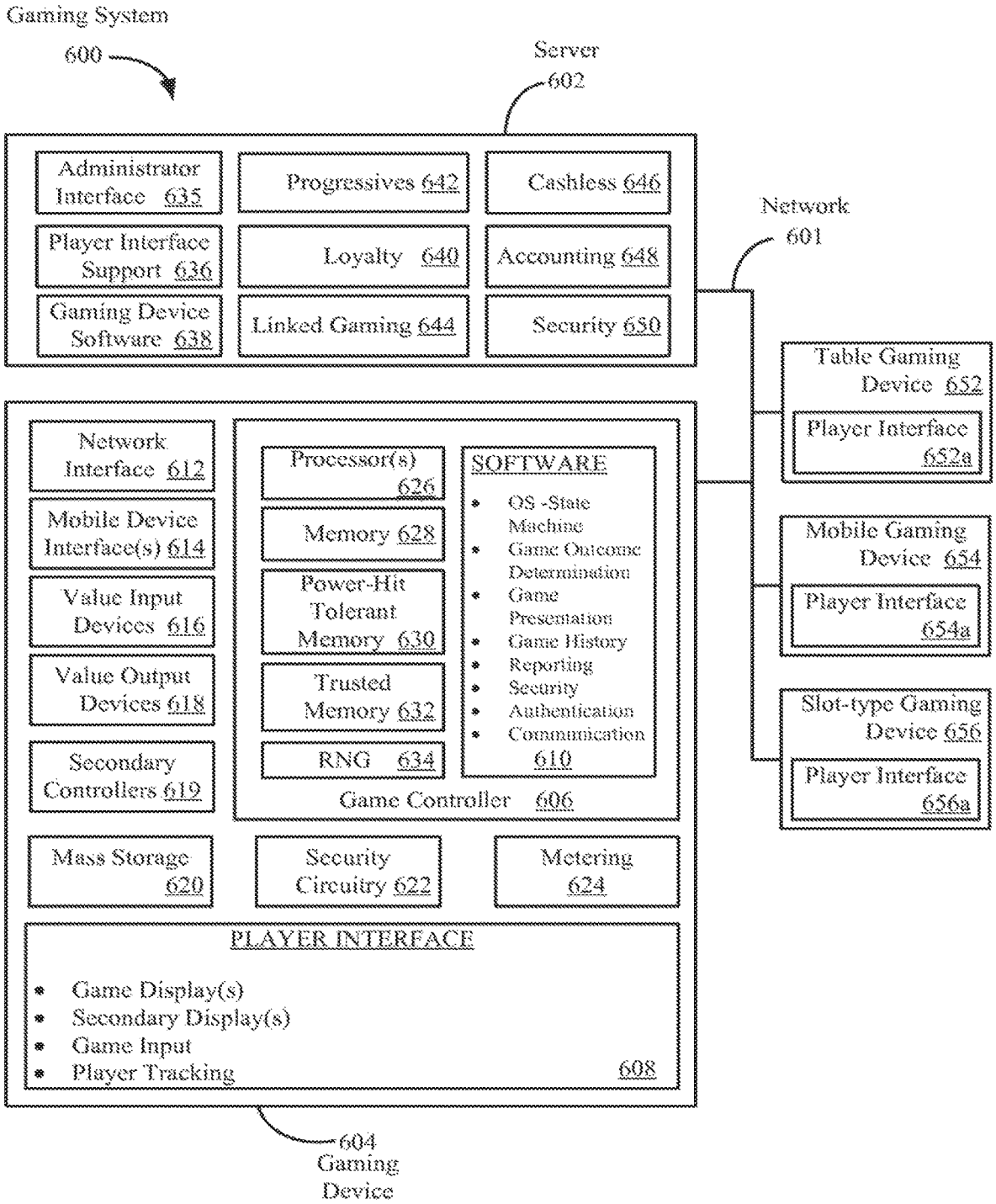
FIG. 5 shows a block diagram of a gaming device in accordance with the described embodiments.
Figure 6:
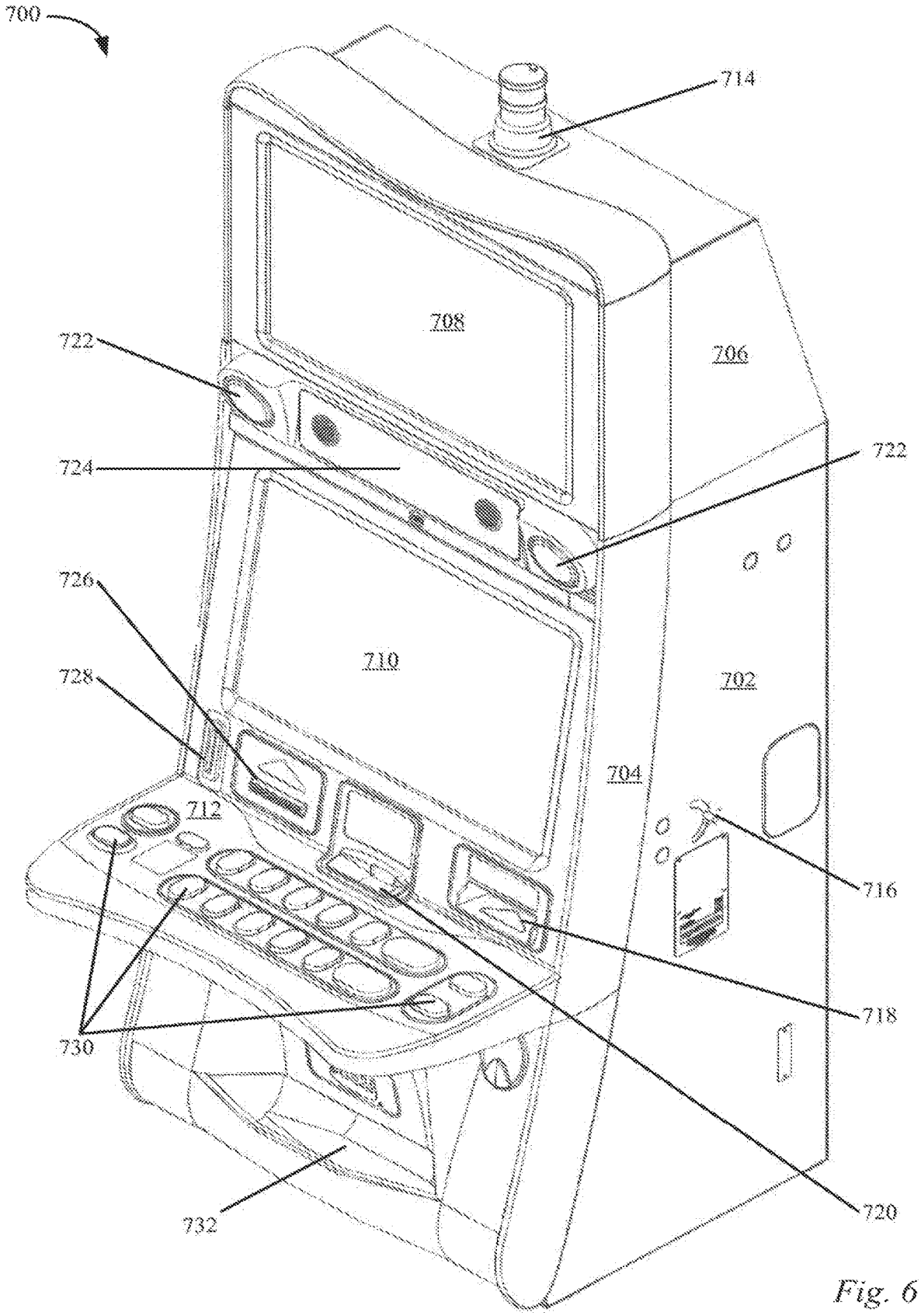
FIG. 6 shows a perspective drawing of a gaming device in accordance with the described embodiments.

Next additional details of EGMs and gaming systems are described with respect to FIGS. 5 and 6. FIG. 5 shows a block diagram of a gaming system 600 in accordance with the described embodiments. The gaming system 600 can include one or more servers, such as server 602, and a variety of gaming devices including but not limited to table gaming devices, such as 652, mobile gaming devices, such as 654, and slot-type gaming devices, such as 656. The table gaming devices, such as 652, can include apparatus associated with table games where a live operator or a virtual operator is employed. The gaming devices and one or more servers can communicate with one another via a network 601. The network can include wired, wireless or a combination of wired and wireless communication connections and associated communication routers.

Some gaming devices, such as 652, 654 and 656, can be configured with a player interface that allows at least 1) selections, such as a wager amount, associated with a wager-based game to be made and 2) an outcome of the wager-based game to be displayed. As an example, gaming devices, 652, 654 and 656, include player interfaces, 652*a*, 654*a* and 656*a*, respectively. Typically, gaming devices with a player interface are located in publically accessible areas, such as a casino floor. On the other hand, some gaming devices, such as server 602, can be located in publically inaccessible areas, such is in a back-room of a casino or even off-site from the casino. Gaming devices located in publically inaccessible areas may not include a player interface. For instance, server 602 does not include a player interface. However, server 602 includes an administrator interface 635 that allows functions associated with the server 602 to be adjusted.

An example configuration of a gaming device is described with respect to gaming device 604. The gaming device 604 can include 1) a game controller 606 for controlling a wager-based game played on the gaming device and 2) a player interface 608 for receiving inputs associated with the wager-based game and for displaying an outcome to the wager-based game. In more detail, the game controller 606 can include a) one or more processors, such as 626, b) memory for holding software executed by the one or more processors, such as 628, c) a power-hit tolerant memory, such as 630, d) one or more trusted memories, such as 632, e) a random number generator and f) a plurality of software applications, 610. The other gaming devices, including table gaming device 652, mobile gaming device 654, slot-type gaming device 656 and server 602, can each include a game controller with all or a portion of the components described with respect to game controller 606.

In particular embodiments, the gaming device can utilize a "state" machine architecture. In a "state" machine architecture critical information in each state is identified and queued for storage to a persistent memory. The architecture doesn't advance to the next state from a current state until all the critical information that is queued for storage for the current state is stored to the persistent memory. Thus, if an error condition occurs between two states, such as a power failure, the gaming device implementing the state machine can likely be restored to its last state prior to the occurrence of the error condition using the critical information associated with its last state stored in the persistent memory. This feature is often called a "roll back" of the gaming device. Examples of critical information can include but are not limited to an outcome determined for a wager-based game, a wager amount made on the wager-based game, an award amount associated with the outcome, credits available on the gaming device and a deposit of credits to the gaming device.

The power-hit tolerant memory 630 can be used as a persistent memory for critical data, such as critical data associated with maintaining a "state" machine on the gaming device. One characteristic of a power-hit tolerant memory 630 is a fast data transfer time. Thus, in the event of a power-failure, which might be indicated by a sudden power fluctuation, the critical data can be quickly loaded from volatile memory, such as RAM associated with the processor 626, into the power-hit tolerant memory 630 and saved.

In one embodiment, the gaming device 605 can be configured to detect power fluctuations and in response, trigger a transfer of critical data from RAM to the power-hit tolerant memory 630. One example of a power-hit tolerant memory 630 is a battery-backed RAM. The battery supplies power to the normally volatile RAM so that in the event of a power failure data is not lost. Thus, a battery-backed RAM is also often referred to as a non-volatile RAM or NV-RAM. An advantage of a battery-backed RAM is that the fast data transfer times associated with a volatile RAM can be obtained.

The trusted memory 632 is typically a read-only memory of some type that may be designed to be unalterable. An EPROM or EEPROM are two types of memory that can be used as a trusted memory 632. The gaming device 604 can include one or more trusted memories. Other types of memories, such as Flash memory, can also be utilized as an unalterable memory and the example of an EPROM or EEPROM is provided for purposes of illustration only.

Prior to installation the contents of a trusted memory, such as 632, can be verified. For instance, a unique identifier, such as a hash value, can be generated on the contents of the memory and then compared to an accepted hash value for the contents of the memory. The memory may not be installed if the generated and accepted hash values do not match. After installation, the gaming device can be configured to check the contents of the trusted memory. For instance, a unique identifier, such as a hash value, can be generated on contents of the trusted memory and compared to an expected value for the unique identifier. If the generated value of the unique identifier and the expected value of the unique identifier don't match, then an error condition can be generated on the gaming device 604. In one embodiment, the error condition can result in the gaming device entering a tilt state where game play is temporarily disabled on the gaming device.

Sometimes verification of software executed on the gaming device 604 can be performed by a regulatory body, such as a government agency. Often software used by a game controller, such as 606, can be highly regulated, where only software approved by a regulatory body is allowed to be executed by the game controller 606. In one embodiment, the trusted memory 632 can store authentication programs and/or authentication data for authenticating the contents of various memories on the gaming device 604. For instance, the trusted memory 632 can store an authentication program that can be used to verify the contents of a mass storage device, such as 620, which can include software executed by the game controller 606.

The random number generator (RNG) 634 can be used to generate random numbers that can be used to determine outcomes for a game of chance played on the gaming device. For instance, for a mechanical or video slot reel type of game, the RNG, in conjunction with a paytable that lists the possible outcomes for a game of chance and the associated awards for each outcome, can be used to generate random numbers for determining reel positions that display the randomly determined outcomes to the wager-based game. In other example, the RNG might be used to randomly select cards for a card game. Typically, as described above, the outcomes generated on a gaming device, such as 604, are considered critical data. Thus, generated outcomes can be stored to the power-hit tolerant memory 630.

Not all gaming devices may be configured to generate their own game outcomes and thus, may not use an RNG for this purpose. In some embodiments, game outcomes can be generated on a remote device, such as server 602, and then transmitted to the gaming device 604 where the outcome and an associated award can be displayed to the player via the player interface 608. For instance, outcomes to a slot-type game or a card game can be generated on server 602 and transmitted to the gaming device 604.

In other embodiments, the gaming device 604 can be used to play central determination games, such as bingo and lottery games. In a central determination game, a pool of game outcomes can be generated and then, particular game outcomes can be selected as needed (e.g., in response to a player requesting to play the central determination game) from the pool of previously generated outcomes. For instance, a pool of game outcomes for a central determination game can be generated and stored on server 602. Next, in response to a request to play the central determination game on gaming device 604, one of the outcomes from the pool can be downloaded to the gaming device 604. A game presentation including the downloaded outcome can be displayed on the gaming device 604.

In other embodiments, thin client type gaming devices, such as mobile gaming devices used to play wager-based video card or video slot games, may be configured to receive at least game outcomes from a remote device and not use an RNG to generate game outcomes locally. The game outcomes can be generated remotely in response to inputs made on the mobile device, such as an input indicating a wager amount and/or an input to initiate the game. This information can be sent from the mobile device to a remote device, such as from mobile gaming device 654 to server 602. After receiving the game outcome from the remote device, a game presentation for the game outcomes generated remotely can be generated and displayed on the mobile device. In some instances, the game presentation can also be generated remotely and then streamed for display to the mobile device.

The game controller 606 can be configured to utilize and execute many different types of software applications 610. Typically, the software applications utilized by the game controller 606 can be highly regulated and may undergo a lengthy approval process before a regulatory body allows the software applications to be utilized on a gaming device deployed in the field, such as in a casino. One type of software application the game controller can utilize is an Operating System (OS). The OS can allow various programs to be loaded for execution by the processor 626, such as programs for implementing a state machine on the gaming device 606. Further, the OS can be used to monitor resource utilization on the gaming device 606. For instance, certain applications, such as applications associated with game outcome generation and game presentation that are executed by the OS can be given higher priority to resources, such as the processor 626 and memory 628, than other applications that can be executing simultaneously on the gaming device.

As previously described, the gaming device 604 can execute software for determining the outcome of a wager-based game and generating a presentation of the determined game outcome including displaying an award for the game. As part of the game outcome presentation one or more of 1) electro-mechanical devices, such as reels or wheels, can be actuated, 2) video content can be output to video displays, 3)

sounds can be output to audio devices, 4) haptic responses can be actuated on haptic devices or 5) combinations thereof, can be generated under control of the game controller 606. The peripheral devices used to generate components of the game outcome presentation can be associated with the player interface 608 where the types of devices that are utilized for the player interface 608 can vary from device to device.

To play a game, various inputs can be required. For instance, via input devices coupled to the gaming device 604, a wager amount can be specified, a game can be initiated or a selection of a game choice associated with the play of the game can be made. The software 610 executed by the game controller 606 can be configured to interpret various signals from the input devices, such as signals received from a touch screen controller or input buttons, and affect the game played on the gaming device in accordance with the received input signals. The input devices can also be part of the player interface 608 provided with the gaming device, such as 604.

In other embodiments, the gaming software 610 executed by the game controller 606 can include applications that allow a game history including the results of a number of past games to be stored, such as the previous 10 or 100 games played on the gaming device 604. The game history can be stored to a persistent memory including but not limited to the power-hit tolerant memory 630. The gaming controller 606 can configured to provide a menu (typically, only operator accessible), that allows the results of a past game to be displayed via the player interface 608. The output from the history menu can include a re-creation of the game presentation associated with a past game outcome, such as a video representation of card hand associated with a video poker game, a video representation of a reel configuration associated with a video slot game, and/or raw data associated with the past game result, such as an award amount, an amount wagered, etc. The history menu can be used for dispute resolution purposes, such as if a player complains that they have not been properly awarded for a game previously played on the gaming device 604.

The reporting software can be used by the game controller 606 to report events that have occurred on the gaming device 604 to remote device, such as server 602. For instance, in one embodiment, the game controller 606 can be configured to report error conditions that have been detected on the gaming device 604, such as if a device has malfunctioned or needs attention. For instance, the reporting software can be used to send a message from the gaming device 604 to the server 602 indicating that a printer on the gaming device needs a refill of tickets. In another embodiment, the gaming controller 606 can be configured to report security events that may have occurred on the gaming device 604, such as but not limited to if a door is opened, a latch is activated or an interior portion of the gaming device 604 has been accessed.

In yet other embodiments, the game controller 606 can be configured to report gaming activity and associated events that has been generated on the gaming device, such as a deposit of cash or an indicia of credit, at the gaming device, a generation of game outcome including an associated award amount and a dispensation of cash or an indicia of credit from the gaming device 604. As part of a loyalty program, the gaming activity can be associated with a particular player. The reporting software can include player tracking elements that allow the gaming activity of a particular player to be reported to a remote device, such as server 602.

The game controller 606 can execute the authentication software to verify the authenticity of data and/or software programs executed on the gaming device 604. For instance, the authentication software can be used to verify the authenticity of data and/or software applications when they are first downloaded to the gaming device 604. Further, the authentication software can be used to periodically verify the authenticity of data and/or software applications currently residing on the gaming device, such as software applications stored on one of the memories coupled to the gaming device 604 including applications loaded into the memory 628 for execution by the processor 626.

The communication software executed by the game controller 606 can be used to communicate with a variety of devices remote to the gaming device 604. For instance, the communication software can be used to communicate with one or more of a) servers remote to the device, such as 602, b) other gaming devices, such as table gaming device 652, mobile gaming device 654 and slot-type gaming device 656 and c) mobile devices carried by casino personnel or players in the vicinity of the gaming device 604. Via the communication software, the game controller can be configured to communicate via many different communication protocols. For instance, different wireless and/or wired communication protocols can be implemented. Further, proprietary or non-proprietary gaming specific protocols can be implemented. For instance, gaming specific non-proprietary communication protocols, such as G2S (game to system), GDS (gaming device standard) and S2S (system to system) communication protocols provided by the Gaming Standards Association (GSA), Fremont, Calif., can be implemented on the gaming devices described herein.

The gaming device 604 can communicate with one or more remote devices via one or more network interfaces, such as 612. For instance, via network interfaces 612 and the network 601, the gaming device 604 can communicate with other gaming devices, such as server 602 and/or gaming devices, 652, 654 and 656. The network interfaces can provide wired or wireless communications pathways for the gaming device 604. Some gaming devices may not include a network interface or can be configured to operate in a stand-alone mode where the network interface is not connected to a network.

In other embodiments, a mobile device interface or interfaces, such as 614, can be provided for communicating with a mobile device, such as a cell phone or a tablet computer carried by players or casino personnel temporarily in the vicinity of the gaming device 604. A wireless communication protocol, such as Bluetooth™ and a Wi-Fi compatible standard, can be used for communicating with the mobile devices via the mobile device interfaces 614. In one embodiment, the mobile device interface can implement a short range communication protocol, such as a near-field communication (NFC) protocol used for mobile wallet applications. NFC is typically used for communication distances of 4 cm or less. In addition, a wired communication interface, such as a docking station, can be integrated into the gaming device, such as 604. The wired communication interface can be configured to provide communications between the gaming device 604 and the mobile device and/or providing power to the mobile device.

Near field communication, or NFC, allows for simplified transactions, data exchange, and connections with a touch. Formed in 2004, the Near Field Communication Forum (NFC Forum) promotes sharing, pairing, and transactions between NFC devices and develops and certifies device compliance with NFC standards. NFC's short range helps keep encrypted identity documents private. Thus, a smartphone or tablet with an NFC chip can make a credit card/debit card payment to a gaming device or serve as keycard or ID card for a loyalty program. Further, an NFC device can act a hotel room key. The user of an NFC device as a hotel room keys and/or a player tracking card instrument may allow fast VIP check-in and reduce staffing requirements.

NFC devices can read NFC tags on a gaming device 604 to get more information about the gaming device including an audio or video presentation. For instance, a tap of an NFC enabled device to a gaming device can be used to instantly share a contact, photo, song, application, video, or website link. In another example, an NFC enabled device can be used to transfer funds to the gaming device or enter the player in a multi-player tournament. As another example, an NFC enabled device can be used to receive information from a gaming device that can be used in a persistent gaming application or a social media application.

Further, NFC enabled signage can include NFC tags that allow a patron to learn more information about the content advertised in the signage. The NFC enabled signage can be part of a gaming system. For instance, a sign advertising a show available at the casino can be configured to transfer information about the show, show times and ticketing information via an NFC tag. As another example, a sign showing jackpot information, such as progressive jackpot information, can be used to transfer information about the jackpot, such as the last time the jackpot was won and where it was won.

In one embodiment, an NFC interface on a gaming device can be used to set-up a higher speed communication between the gaming device and another NFC enabled device such as smart phone. The higher speed communication rates can be used for expanded content sharing. For instance, a NFC and Bluetooth enabled gaming device can be tapped by an NFC and Bluetooth enabled smart phone for instant Bluetooth pairing between the devices. Instant Bluetooth pairing between a gaming device and an NFC enabled device, such as a smartphone, can save searching, waiting, and entering codes. In another example, a gaming device can be configured as an NFC enabled router, such as a router supporting a Wi-Fi communication standard. Tapping an NFC enabled device to an NFC enabled and Wi-Fi enabled gaming device can be used to establish a Wi-Fi connection between the two devices.

The gaming device 604 can include one or more each of value input devices 616 and value output device 618. The value input devices 616 can be used to deposit cash or indicia of credit onto the gaming device. The cash or indicia of credit can be used to make wagers on games played on the gaming device 604. Examples of value input devices 616 include but are not limited to a magnetic-striped card or smart card reader, a bill and/or ticket acceptor, a network interface for downloading credits from a remote source, a wireless communication interface for reading credit data from nearby devices and a coin acceptor. A few examples of value input devices are shown in FIG. 6.

The value output devices can be used to dispense cash or indicia of credit from the gaming device 604. Typically, the indicia of credit can be exchanged for cash. For instance, the indicia of credit can be exchanged at a cashier station or at a redemption station. Examples of value output devices can include a network interface for transferring credits into a remote account, a wireless communication interface that can be used with a mobile device implementing mobile wallet application, a coin hopper for dispensing coins or tokens, a bill dispenser, a card writer, a printer for printing tickets or cards redeemable for cash or credits. Another type of value output device is a merchandise dispenser, which can be configured to dispense merchandise with a tangible value from a gaming device. A few examples of value output devices are shown in FIG. 6.

The combination of value input devices 616 and value output devices 618 can vary from device to device. In some embodiments, a gaming device 604 may not include a value input device or a value output device. For instance, a thin-client gaming device used in a mobile gaming application may not include a value input device and a value output device. Instead, a remote account can be used to maintain the credits won or lost from playing wager-based games via the mobile device. The mobile device can be used to access the account and affect the account balance via game play initiated on the mobile device. Credits can be deposited or withdrawn from the remote account via some mechanism other than via the mobile device interface.

In yet other embodiments, the gaming device 604 can include one or more secondary controllers 619. The secondary controllers can be associated with various peripheral devices coupled to the gaming device, such as the value input devices and value output devices described in the preceding paragraphs. As another example, the secondary controllers can be associated with peripheral devices associated with the player interface 608, such as input devices, video displays, electro-mechanical displays and a player tracking unit. In some embodiments, the secondary controllers can receives instructions and/or data from and provide responses to the game controller 606. The secondary controller can be configured to interpret the instructions and/or data from the game controller 606 and control a particular device according to the received instructions and/or data. For instance, a print controller may receive a print command with a number of parameters, such as a credit amount and in response print a ticket redeemable for the credit amount. In another example, a touch screen controller can detect touch inputs and send information to the game controller 606 characterizing the touch input.

In a particular embodiment, a secondary controller can be used to control a number of peripheral devices independently of the game controller 606. For instance, a player tracking unit can include one or more of a video display, a touch screen, card reader, network interface or input buttons. A player tracking controller can control these devices to provide player tracking services and bonusing on the gaming device 604. In alternate embodiments, the game controller 604 can control these devices to perform player tracking functions. An advantage of performing player tracking functions via a secondary controller, such as a player tracking controller, is that since the player tracking functions don't involve controlling the wager-based game, the software on the player tracking unit can be developed modified via a less lengthy and regulatory intensive process than is required for software executed by the game controller 606, which does control the wager-based game. In general, using a secondary controller, certain functions of the gaming device 604 that are not subject to as much regulatory scrutiny as the game play functions can be decoupled from the game controller 606 and implemented on the secondary controller instead. An advantage of this approach, like for the player tracking controller, is that software approval process for the software executed by the secondary controller can be less intensive than the process needed to get software approved for the game controller.

A mass storage unit(s) 620, such as a device including a hard drive, optical disk drive, flash memory or some other memory storage technology can be used to store applications and data used and/or generated by the gaming device 604. For instance, a mass storage unit, such as 620, can be used to store gaming applications executed by the game controller 606 where the gaming device 604 can be configured to receive downloads of game applications from remote devices, such as server 602. In one embodiment, the game controller 606 can include its own dedicated mass storage unit. In another embodiment, critical data, such as game history data stored in the power-hit tolerant memory 630 can be moved from the power-hit tolerant memory 630 to the mass storage unit 620 at periodic intervals for archival purposes and to free up space in the power-hit tolerant memory 630.

The gaming device 604 can include security circuitry 622, such as security sensors and circuitry for monitoring the sensors. The security circuitry 622 can be configured to operate while the gaming device is receiving direct power and operational to provide game play as well as when the gaming device is uncoupled from direct power, such as during shipping or in the event of a power failure. The gaming device 604 can be equipped with one or more secure enclosures, which can include locks for limiting access to the enclosures. One or more sensors can be located within the secure enclosures or coupled to the locks. The sensors can be configured to generate signals that can be used to determine whether secure enclosures have been accessed, locks have been actuated or the gaming device 604, such as a mobile device has been moved to an unauthorized area. The security monitoring circuitry can be configured to generate, store and/or transmit error events when the security events, such as accessing the interior of the gaming device, have occurred. The error events may cause the game controller 606 to place itself in a "safe" mode where no game play is allowed until the error event is cleared.

The server 602 can be configured to provide one or more functions to gaming devices or other servers in a gaming system 600. The server 602 is shown performing a number of different functions. However, in various embodiments, the functions can be divided among multiple servers where each server can communicate with a different combination of gaming devices. For instance, player interface support 636 and gaming device software 638 can be provided on a first server, progressives can be provided on a second server, loyalty program functions 640 and accounting 648 can be provided on a third server, linked gaming 644 can be provided on a fourth server, cashless functions 646 can be provided on a fifth server and security functions 650 can be provided on a sixth server. In this example, each server can communicate with a different combination of gaming devices because each of the functions provided by the servers may not be provided to every gaming device in the gaming system 600. For instance, the server 602 can be configured to provide progressive gaming functions to gaming devices 604, 652 and 656 but not gaming device 654. Thus, the server 602 may not communicate with the mobile gaming device 654 if progressive functions are not enabled on the mobile gaming device at a particular time.

Typically, each server can include an administrator interface that allows the functions of a server, such as 602, to be configured and maintained. Each server 602 can include a processor and memory. In some embodiments, the servers, such as 602, can include a game controller with components, such as but not limited to a power-hit tolerant memory 630, a trusted memory 632 and an RNG 634 described with respect to gaming device 604. The servers can include one or more network interfaces on which wired or wireless communication protocols can be implemented. Next, some possible functions provided by the server 602 are described. These functions are described for the purposes of illustration only and are not meant to be limiting.

The player interface support 636 can be used to serve content to gaming devices, such as 604, 652, 654 and 656, remote to the server. The content can include video and audio content that can be output on one of the player interfaces, such as 608, 652*a*, 654*a* and 656*a*. Further, the content can be configured to utilize unique features of a particular player interface, such as video displays, wheels or reels, if the particular player interface is so equipped.

In one embodiment, via the player interface support, content can be output to all or a portion of a primary video display that is used to output wager-based game outcomes on a player interface associated with a gaming device. For instance, a portion of the primary display can be allocated to providing a "service window" on the primary video display where the content in the service window is provided from a server remote to the gaming device. In particular embodiments, the content delivered from the server to a gaming device as part of the player interface support 636 can be affected by inputs made on the gaming device. For instance, the service window can be generated on a touch screen display where inputs received via the service window can be sent back to server 602. In response, to the received inputs, the server 602 can adjust the content that is displayed on the remote gaming device that generated the inputs.

The "service window" application can be generated by software code that is executed independently of other game controller software in a secure "sandbox." Via the sandbox, an executable can be given limited access to various resources on an EGM, such as a portion of the CPU resources and memory available on a game controller. The memory can be isolated from the memory used by other processes, such as game processes executed by the game controller.

As described above, a service window application can be allowed to control, send and/or receive data from secondary devices on a gaming device, such as a video display, a touch screen power interfaces or communication interfaces. A service window application allowed to utilize a communication interface, such as a wireless communication interface, can be configured to communicate with a portable electronic device via the communication interface. Thus, a service window application can be configured to implement attract features as described above independently of a game controller on an EGM. Further details of utilizing a service window on a gaming device on an EGM are described in U.S. patent application Ser. No. 12/209,608, by Weber et al., filed Sep. 12, 2008, titled "Gaming Machine with Externally Controlled Content Display," which is incorporated herein by reference in its entirety and for all purposes.

In another embodiment, via the video display, the service window application can be configured to output data in an optical image format, such as a 1-D/2-D bar-code or a QR code. The optically formatted data can be captured by a camera on the portable electronic device. For instance, a receipt indicating the acceptance of a virtual ticket voucher or virtual currency on the gaming device can be displayed in the service window in a QR code format and transferred to a user's portable electronic device via an image capture device on their portable electronic device. In another embodiment, virtual ticket voucher information can be transferred to a portable electronic device as optically formatted image data.

If a player's identity is known, then the player interface support 636 can be used to provide custom content to a remote gaming device, such as 604. For instance, a player can provide identification information, such as information indicating their membership in a loyalty program, during their utilization of a gaming device. The custom content can be selected to meet the identified player's interests. In one embodiment, the player's identity and interests can be managed via a loyalty program, such as via a loyalty program account associated with loyalty function 640. The custom content can include notifications, advertising and specific offers that are determined to be likely of interest to a particular player.

The gaming device software function 638 can be used to provide downloads of software for the game controller and/or second controllers associated with peripheral devices on a gaming device. For instance, the gaming device software 638 may allow an operator and/or a player to select a new game for play on a gaming device. In response to the game selection, the gaming device software function 638 can be used to download game software that allows a game controller to generate the selected game. In another example, in response to determining that a new counterfeit bill is being accepted by bill acceptors in the gaming system 600, the gaming device software function 638 can be used to download a new detection algorithm to the bill acceptors that allow the counterfeit bill to be detected.

The progressive gaming function 642 can be used to implement progressive game play on one or more gaming devices. In progressive game play, a portion of wagers associated with the play of a progressive game is allocated to a progressive jackpot. A group of gaming devices can be configured to support play of the progressive game and contribute to the progressive jackpot. In various embodiments, the gaming devices contributing to a progressive jackpot may be a group of gaming devices collocated near one another, such as a bank of gaming machines on a casino floor, a group of gaming devices distributed throughout a single casino, or group of gaming devices distributed throughout multiple casinos (e.g., a wide area progressive). The progressive gaming function 642 can be used to receive the jackpot contributions from each of the gaming devices participating in the progressive game, determine a current jackpot and notify participating gaming devices of the current progressive jackpot amount, which can be displayed on the participating gaming devices if desired.

The loyalty function 640 can be used to implement a loyalty program within a casino enterprise. The loyalty function 640 can be used to receive information regarding activities within a casino enterprise including gaming and non-gaming activities and associate the activities with particular individuals. The particular individuals can be known or may be anonymous. The loyalty function 640 can used to store a record of the activities associated with the particular individuals as well as preferences of the individuals if known. Based upon the information stored with the loyalty function 640 comps (e.g., free or discounted services including game play), promotions and custom contents can be served to the particular individuals.

The linked gaming function 644 can be used to used provide game play activities involving player participating as a group via multiple gaming devices. An example, a group of player might be competing against one another as part of a slot tournament. In another example, a group of players might be working together in attempt to win a bonus that can be shared among the players.

The cashless function 646 can enable the redemption and the dispensation of cashless instruments on a gaming device. For instance, via the cashless function, printed tickets, serving as a cashless instrument, can be used to transfer credits from one gaming device to another gaming device. Further, the printed tickets can be redeemed for cash. The cashless function can be used to generate identifying information that can be stored to a cashless instrument, such as a printed ticket, that allows the instrument to later be authenticated. After authentication, the cashless instrument can be used for additional game play or redeemed for cash.

The accounting function can receive transactional information from various gaming devices within the gaming system 600. The transactional information can relate to value deposited on each gaming device and value dispensed from each gaming device. The transactional information, which can be received in real-time, can be used to assess the performance of each gaming device as well as an overall performance of the gaming system. Further, the transactional information can be used for tax and auditing purposes.

The security function 650 can be used to combat fraud and crime in a casino enterprise. The security function 650 can be configured to receive notification of a security event that has occurred on a gaming device, such as an attempt at illegal access. Further, the security function 650 can receive transactional data that can be used to identify if gaming devices are being utilized in a fraudulent or unauthorized manner. The security function 650 can be configured to receive, store and analyze data from multiple sources including detection apparatus located on a gaming device and detection apparatus, such as cameras, distributed throughout a casino. In response to detecting a security event, the security function 650 can be configured to notify casino personnel of the event. For instance, if a security event is detected at a gaming device, a security department can be notified. Depending on the security event, one or more team members of the security department can be dispatched to the vicinity of the gaming device. Next, a perspective diagram of a slot-type gaming device that can include all or a portion of the components described with respect to gaming device 604 is described.

FIG. 6 shows a perspective drawing of a gaming device 700 in accordance with the described embodiments. The gaming device 700 is example of what can be considered a "thick-client." Typically, a thick-client is configurable to communicate with one or more remote servers but provides game play, such as game outcome determination, independent of the remote servers. In addition, a thick-client can be considered as such because it includes cash handling capabilities, such as peripheral devices for receiving cash, and a secure enclosure within the device for storing the received cash. In contrast, thin-client device, such as a mobile gaming device, may be more dependent on a remote server to provide a component of the game play on the device, such as game outcome determination, and/or may not include peripheral devices for receiving cash and an associated enclosure for storing it.

Many different configurations are possible between thick and thin clients. For instance, a thick-client device, such as 700, deployed in a central determination configuration, may receive game outcomes from a remote server but still provide cash handling capabilities. Further, the peripheral devices can vary from gaming device to gaming device. For instance, the gaming device 700 can be configured with electro-mechanical reels to display a game outcome instead of a video display, such as 710. Thus, the features of gaming device 700 are described for the purposes of illustration only and are not meant to be limiting.

The gaming device 700 can include a main cabinet 702. The main cabinet 702 can provide a secure enclosure that prevents tampering with the device components, such as a game controller (not shown) located within the interior of the main cabinet and cash handing devices including a coin acceptor 720, a ticket printer 726 and a bill acceptor 718. The main cabinet can include an access mechanism, such as door 704, which allows an interior of the gaming device 700 to be accessed. The actuation of the door 704 can be controlled by a locking mechanism, such as lock 716. The lock 716, the door 704 and the interior of the main cabinet 702 can be monitored with security sensors for detecting whether the interior has been accessed. For instance, a light sensor can be provided to detect a change in light-level in response to the door 704 being opened.

The interior of the main cabinet 700 can include additional secure enclosure, which can also be fitted with locking mechanisms. For instance, the game controller, such as game controller 606, shown in FIG. 5, can be secured within a separate locked enclosure. The separate locked enclosure for the game controller may allow maintenance functions to be performed on the gaming device, such as emptying a drop box for coins, emptying a cash box or replacing a device, while preventing tampering with the game controller. Further, in the case of device with a coin acceptor, 720, the separate enclosure can protect the electronics of the game controller from potentially damaging coin dust.

A top box 706 can be mounted to the top of the main cabinet 702. A number of peripheral devices can be coupled to the top box 706. In FIG. 6, a display device 708 and a candle device 714 are mounted to the top box 706. The display device 708 can be used to display information associated with game play on the gaming device 700. For instance, the display device 708 can be used to display a bonus game presentation associated with the play of a wager-based game (One or more bonus games are often features of many wager-based games). In another example, the display device 708 can be used to display information associated with a progressive game, such as one or more progressive jackpot amounts. In yet another example, the display device 708 can be used to display an attract feature that is intended to draw a potential player's attention to the gaming device 700 when it is not in use.

The candle device 714 can include a number of lighting elements. The lighting elements can be lit in different patterns to draw attention to the gaming device. For instance, one lighting pattern may indicate that service is needed at the gaming device 700 while another light pattern may indicate that a player has requested a drink. The candle device 714 is typically placed at the top of gaming device 700 to increase its visibility. Other peripheral devices, including custom bonus devices, such as reels or wheels, can be included in a top box 706 and the example in FIG. 6 is provided for illustrative purposes only. For instance, some of the devices coupled to the main cabinet 702, such as printer 726, can be located in a different top box configuration.

The gaming device 700 provides a player interface that allows the play of a game, such as wager-based game. In this embodiment, the player interface includes 1) a primary video display 710 for outputting video images associated with the game play, 2) audio devices, such as 722, for outputting audio content associated with game play and possibly casino operations, 3) an input panel 712 for at least providing game play related inputs and 4) a secondary video display 708 for outputting video content related to the game play (e.g., bonus material) and/or the casino enterprise (e.g., advertising). In particular embodiments, one or both of the video displays, 708 and 710, can be equipped with a touch screen sensor and associated touch screen controller, for detecting touch inputs, such as touch inputs associated with the play of a game or a service window output to the display device.

The input panel 712 can include a number of electro-mechanical input buttons, such as 730, and/or touch sensitive surfaces. For instance, the input panel can include a touch screen equipped video display to provide a touch sensitive surface. In some embodiments, the functions of the electro-mechanical input buttons can be dynamically reconfigurable. For instance, the function of the electro-mechanical input buttons may be changed depending on the game that is being played on the gaming device. To indicate function changes, the input buttons can each include a configurable display, such as an e-ink or a video display for indicating the function of button. The output of the configurable display can be adjusted to account for a change in the function of the button.

The gaming device 700 includes a card reader 728, a printer 726, a coin acceptor 720, a bill and/or ticket acceptor 720 and a coin hopper (not shown) for dispensing coins to a coin tray 732. These devices can provide value input/output capabilities on the gaming device 700. For instance, the printer 726 can be used to print out tickets redeemable for cash or additional game play. The tickets generated by printer 726 as well as printers on other gaming devices can be inserted into bill and ticket acceptor 718 to possibly add credits to the gaming device 700. After the ticket is authenticated, credits associated with the ticket can be transferred to the gaming device 700.

The device 718 can also be used to accept cash bills. After the cash bill is authenticated, it can be converted to credits on the gaming device and used for wager-based game play. The coin acceptor 720 can be configured to accept coins that are legal tender or tokens, such as tokens issued by a casino enterprise. A coin hopper (not shown) can be used to dispense coins that are legal tender or tokens into the coin tray 732.

The various aspects, embodiments, implementations or features of the described embodiments can be used separately or in any combination. Various aspects of the described embodiments can be implemented by software, hardware or a combination of hardware and software. The computer readable medium is any data storage device that can store data which can thereafter be read by a computer system. Examples of the computer readable medium include read-only memory, random-access memory, CD-ROMs, DVDs, magnetic tape and optical data storage devices. The computer readable medium can also be distributed over network-coupled computer systems so that the computer readable code is stored and executed in a distributed fashion.

The foregoing description, for purposes of explanation, used specific nomenclature to provide a thorough understanding of the invention. However, it will be apparent to one skilled in the art that the specific details are not required in order to practice the invention. Thus, the foregoing descriptions of specific embodiments of the present invention are presented for purposes of illustration and description. They are not intended to be exhaustive or to limit the invention to the precise forms disclosed. It will be apparent to one of ordinary skill in the art that many modifications and variations are possible in view of the above teachings.

The embodiments were chosen and described in order to best explain the principles of the invention and its practical applications, to thereby enable others skilled in the art to best utilize the invention and various embodiments with various modifications as are suited to the particular use contemplated. It is intended that the scope of the invention be defined by the following claims and their equivalents. While the embodiments have been described in terms of several particular embodiments, there are alterations, permutations, and equivalents, which fall within the scope of these general concepts. It should also be noted that there are many alternative ways of implementing the methods and apparatuses of the present embodiments. It is therefore intended that the following appended claims be interpreted as including all such alterations, permutations, and equivalents as fall within the true spirit and scope of the described embodiments.

The invention is claimed as follows:

1. An electronic gaming machine comprising:

a display device;

an input device, a payment acceptor;

at least one processor; and at least one memory device which stores a plurality of instructions, which when executed by the at least one processor, cause the at least one processor to:

responsive to a physical item being received via the payment acceptor, modify a credit balance based, at least in part, on a monetary value associated with the received physical item, the credit balance being maintained by the at least one processor independent of any server, responsive to a determination occurring to establish communication with a portable electronic device which is associated with a player, distinct from the input device and distinct from the display device:

establish a wireless communication session with the portable electronic device, after establishing the wireless communication session with the portable electronic device:

responsive to a game initiation event, determine a game outcome for a play of a game, determine a multimedia stream associated with a first portion of the play of the game, said determination of the multimedia stream being based, at least in part, on at least one attribute of the portable electronic device, wherein for a first attribute of the at least one attribute of the portable electronic device:

a first multimedia stream associated with the play of the game and comprising audio content, video content and haptic content is determined responsive to a first determination of the first attribute, and a second, different multimedia stream associated with the play of the game and comprising audio content, video content and no haptic content is determined responsive to a second, different determination of the first attribute, cause a wireless communication of the determined multimedia stream associated with the first portion of the play of the game to the portable electronic device, and cause the display device to display, in conjunction with the determined multimedia stream associated with the first portion of the play of the game being provided by the portable electronic device, of a second portion of the play of the game, wherein the determined game outcome is displayed via at least one of the display device and the determined multimedia stream communicated to the portable electronic device, and responsive to a cashout input being received via the input device prior to any termination of the established wireless communication session with the portable electronic device:

terminate the established wireless communication session with the portable electronic device, and separate from the termination of the established wireless communication session with the portable electronic device, cause an initiation of any payout associated with the credit balance.

2. The electronic gaming machine of claim 1, wherein the determination to establish communication with the portable electronic device occurs upon at least one input made by the player.

3. The electronic gaming machine of claim 1, wherein the portable electronic device is selected from the group consisting of: a cellular phone, a smartphone, a laptop, a netbook and a tablet computer.

4. The electronic gaming machine of claim 1, wherein the audio content of said multimedia stream associated with the first portion of the play of the game comprises at least one of: audio content associated with the determined game outcome of the play of the game and audio content associated with any award associated with the determined game outcome of the play of the game, and the video content of said multimedia stream associated with the first portion of the play of the game comprises at least one of: video content associated with the determined game outcome of the play of the game and video content associated with any award associated with the determined game outcome of the play of the game.

5. The electronic gaming machine of claim 1, wherein when executed by the at least one processor responsive to the determination occurring to establish communication with the portable electronic device, the plurality of instructions cause the at least one processor to determine the multimedia stream, at least in part, based on the determined at least one communication property.

6. The electronic gaming machine of claim 5, wherein the at least one communication property is selected from the group consisting of: a bandwidth of a network associated with the portable electronic device and a speed of the network associated with the portable electronic device.

7. A method of operating an electronic gaming machine, said method comprising:

displaying, by a display device of the electronic gaming machine that is distinct from any portable electronic device, a credit balance that is maintained by a processor of the electronic gaming machine independent of any server, responsive to a determination occurring to establish communication with a portable electronic device associated with a player:

establishing, via a wireless interface of the electronic gaming machine, a wireless communication session with the portable electronic device, after establishing the wireless communication session with the portable electronic device:

responsive to a game initiation event, determining, by the processor of the electronic gaming machine, a game outcome for a play of a game, determining, by the processor, a multimedia stream associated with a first portion of the play of the game, said determination of the multimedia stream being based, at least in part, on at least one attribute of the portable electronic device, wherein for a first attribute of the at least one attribute of the portable electronic device:

a first multimedia stream associated with the play of the game and comprising audio content, video content and haptic content is determined responsive to a first determination of the first attribute, and a second, different multimedia stream associated with the play of the game and comprising audio content, video content and no haptic content is determined responsive to a second, different determination of the first attribute, causing a wireless communication of the determined multimedia stream associated with the first portion of the play of the game to the portable electronic device, displaying, by the display device of the electronic gaming machine and in conjunction with the determined multimedia stream associated with the first portion of the play of the game being provided by the portable electronic device, a second portion of the play of the game, wherein the determined game outcome is displayed via at least one of the display device and the determined multimedia stream communicated to the portable electronic device, and responsive to a cashout input being received, prior to any termination of the established wireless communication session with the portable electronic device, via an input device of the electronic gaming machine that is distinct from the portable electronic device:

terminating the established wireless communication session with the portable electronic device, and separate from the termination of the established wireless communication session with the portable electronic device, causing, by the processor, an initiation of any payout associated with the credit balance.

8. The method of claim 7, wherein the determination to establish communication with the portable electronic device occurs upon at least one input made by the player.

9. The method of claim 7, wherein the portable electronic device is selected from the group consisting of: a cellular phone, a smartphone, a laptop, a netbook and a tablet computer.

10. The method of claim 7, wherein the audio content of said multimedia stream associated with the first portion of the play of the game comprises at least one of: audio content associated with the determined game outcome of the play of the game and audio content associated with any award associated with the determined game outcome of the play of the game, and the video content of said multimedia stream associated with the first portion of the play of the game comprises at least one of: video content associated with the determined game outcome of the play of the game and video content associated with any award associated with the determined game outcome of the play of the game.

11. The method of claim 7, further comprising, responsive to the determination occurring to establish communication with the portable electronic device, determining, by at least one processor, the multimedia stream, at least in part, based on at least one communication property.

12. The method of claim 11, wherein the at least one communication property is selected from the group consisting of: a bandwidth of a network associated with the portable electronic device and a speed of the network associated with the portable electronic device.

13. The method of claim 7, which is provided through a data network.

14. The method of claim 13, wherein the data network is an internet.

* * * * *